US007154221B2

(12) United States Patent
Son et al.

(10) Patent No.: US 7,154,221 B2
(45) Date of Patent: Dec. 26, 2006

(54) PLASMA DISPLAY PANEL INCLUDING SUSTAIN ELECTRODES HAVING DOUBLE GAP AND METHOD OF MANUFACTURING THE PANEL

(75) Inventors: Seung-hyun Son, Gyeonggi-do (KR); Young-mo Kim, Suwon-si (KR); Hidekazu Hatanaka, Seongnam-si (KR); Vassili Leniachine, Suwon-si (KR); Nikolai Shpackovsky, Suwon-si (KR); Sang-hun Jang, Youngin-si (KR); Mi-jeong Song, Suwon-si (KR); Hyo-june Kim, Youngin-si (KR); Gi-young Kim, Chungju-si (KR); Hyoung-bin Park, Seongnam-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 202 days.

(21) Appl. No.: 10/747,120

(22) Filed: Dec. 30, 2003

(65) Prior Publication Data

US 2004/0150340 A1 Aug. 5, 2004

(30) Foreign Application Priority Data

Dec. 31, 2002 (KR) ..... 10-2002-0087946
Jul. 25, 2003 (KR) ..... 10-2003-0051631

(51) Int. Cl.
*H01J 17/49* (2006.01)

(52) U.S. Cl. ..... 313/582; 313/583; 313/584

(58) Field of Classification Search ..... 313/582–587
See application file for complete search history.

(56) References Cited

U.S. PATENT DOCUMENTS 5,066,890 A * 11/1991 Salavin et al. ..... 313/585
5,541,618 A 7/1996 Shinoda
5,587,624 A * 12/1996 Komaki ..... 313/584
5,661,500 A 8/1997 Shinoda et al.
5,663,741 A 9/1997 Kanazawa (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Mariceli Santiago
(74) *Attorney, Agent, or Firm*—Robert E. Bushnell, Esq.

(57) ABSTRACT

A plasma display panel (PDP) and a method of manufacturing the panel includes sustain electrodes having a double gap structure and a predetermined resistance value. Each of the sustain electrodes includes a main electrode for sustaining a discharge and an auxiliary electrode for starting a low-voltage discharge without decreasing efficiency. A gap between auxiliary electrodes included in different sustain electrodes, respectively, is narrower than a gap between the different sustain electrodes. Each auxiliary electrode is formed between barrier ribs or immediately above a barrier rib. A ditch is formed in a dielectric layer covering the main electrodes and the auxiliary electrodes. The ditch is formed immediately above an auxiliary electrode.

54 Claims, 15 Drawing Sheets

U.S. PATENT DOCUMENTS

| | | | | |
|---|---|---|---|---|
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 5,990,617 | A * | 11/1999 | Kanae et al. | 313/582 |
| 6,172,461 | B1 * | 1/2001 | Ha | 313/585 |
| RE37,444 | E | 11/2001 | Kanazawa | |
| 6,376,986 | B1 * | 4/2002 | Takagi et al. | 313/582 |
| 6,384,531 | B1 * | 5/2002 | Park et al. | 313/584 |
| 6,525,470 | B1 | 2/2003 | Amemiya | |
| 6,630,916 | B1 | 10/2003 | Shinoda | |
| 6,707,436 | B1 | 3/2004 | Setoguchi et al. | |
| 6,819,046 | B1 * | 11/2004 | Hirano | 313/582 |
| 6,856,305 | B1 * | 2/2005 | Nagano | 345/60 |
| 2002/0084750 | A1 | 7/2002 | Su et al. | |
| 2002/0190652 | A1 | 12/2002 | Do et al. | |
| 2005/0029946 | A1 * | 2/2005 | Kwon et al. | 313/584 |

FOREIGN PATENT DOCUMENTS

| | | | |
|---|---|---|---|
| JP | 2845183 | | 10/1998 |
| JP | 2917279 | | 4/1999 |
| JP | 11297215 | | 10/1999 |
| JP | 2001-043804 | | 2/2001 |
| JP | 2001-325888 | | 11/2001 |
| KR | 2001018030 | A * | 3/2001 |

OTHER PUBLICATIONS

European Office Action issued by the European Patent Office in applicant's corresponding European Patent Application No. EP 03258214, issued on Aug. 29, 2005.

* cited by examiner

PLASMA DISPLAY PANEL INCLUDING SUSTAIN ELECTRODES HAVING DOUBLE GAP AND METHOD OF MANUFACTURING THE PANEL

CLAIM OF PRIORITY

This application claims priority based on an application entitled PLASMA DISPLAY PANEL INCLUDING SUSTAIN ELECTRODES HAVING DOUBLE GAP AND METHOD OF MANUFACTURING THE SAME, filed in the Korean Intellectual Property Office on Dec. 31, 2002, and assigned Serial No. 2002-87946, and on an application entitled PLASMA DISPLAY PANEL INCLUDING SUSTAIN ELECTRODES HAVING DOUBLE GAP AND METHOD OF MANUFACTURING THE SAME, filed in the Korean Intellectual Property Office on Jul. 25, 2003, and assigned Serial No. 2003-51631, the contents of which are hereby incorporated by reference.

BACKGROUND OF THE INVENTION

1. Technical Field

The present invention relates to a flat panel display apparatus, and more particularly, to a plasma display panel (PDP) including sustain electrodes having a double gap and a method of manufacturing the panel.

2. Related Art

A PDP is a display apparatus using a gas discharge. A PDP is more suitable to a large size display than other flat panel displays such as a liquid crystal display (LCD), a field emission display (FED), and an electroluminescent display (ELD).

A large size PDP can be manufactured because it has a structure, in which a front glass substrate having a discharge electrode is separated from a rear glass substrate having a fluorescent material by a micro gap of 0.1–0.2 mm and plasma is formed therebetween, so that it operates as long as the gap between the front and rear glass substrates is exactly maintained.

PDPs are divided into a direct current (DC) type and an alternating current (AC) type. In the DC type, an electrode is directly exposed to a discharge gas, so the electrode sputters and evaporates with discharge repetitions. The AC type overcomes these problems of the DC type. In order to prevent an electrode from evaporating during a discharge, the AC type includes a dielectric layer covering the electrode. In addition, in order to prevent a fluorescent material from being damaged by ions generated during a discharge, the AC type includes electrodes, which are arranged in a horizontal direction. When starting a discharge using these electrodes, ions generated during the discharge are prevented from being injected into the fluorescent material, and only ultraviolet rays generated during the discharge are radiated onto the fluorescent material.

FIG. 1 shows the structure of such an AC type PDP (hereinafter, referred to as a conventional PDP). Referring to FIG. 1, the conventional PDP includes a front glass substrate 10 and a rear glass substrate 12, which face each other in parallel. Transparent first and second sustain electrodes 14*a* and 14*b* are arranged in parallel on a side (hereinafter, referred to as a rear side) of the front glass substrate 10, which faces the rear glass substrate 12. As shown in FIG. 2, a gap "d" exists between the first and second sustain electrodes 14*a* and 14*b*. First and second bus electrodes 16*a* and 16*b* are disposed on the first and second sustain electrodes 14*a* and 14*b*, respectively, in parallel with the first and second sustain electrodes 14*a* and 14*b*, respectively. The first and second bus electrodes 16*a* and 16*b* prevent a drop in voltage caused by resistance during a discharge. The first and second sustain electrodes 14*a* and 14*b* and the first and second bus electrodes 16*a* and 16*b* are covered with a first dielectric layer 18. The first dielectric layer 18 is covered with a protective layer 20. The protective layer 20 protects the first dielectric layer 18 from a discharge so that the conventional PDP can reliably operate for a long period of time and emits a large amount of secondary electrons during the discharge, thereby lowering a discharge voltage. A magnesium oxide (MgO) layer is widely used as the protective layer 20.

A plurality of address electrodes 22 used for writing data are disposed on the rear glass substrate 12. The address electrodes 22 are arranged in parallel with one another and are perpendicular to the first and second sustain electrodes 14*a* and 14*b*. Three address electrodes 22 are provided for each pixel. In a single pixel, three address electrodes 22 correspond to a red fluorescent material, a green fluorescent material, and a blue fluorescent material, respectively. The address electrodes 22 are covered with a second dielectric layer 24. A plurality of barrier ribs are disposed on the second dielectric layer 24, which is provided for light reflection. The plurality of barrier ribs 26 are spaced apart by a predetermined gap and parallel with the address electrodes 22. Each barrier rib 26 is disposed on the second dielectric layer 24 between adjacent address electrodes 22. In other words, the address electrodes 22 are alternately arranged with the barrier ribs 26. The barrier ribs 26 become in close contact with the protective layer 20 provided on the rear side of the front glass substrate 10 when the front and rear glass substrates 10 and 12 are joined together. Fluorescent materials 28*a*, 28*b*, and 28*c* are deposited in gaps between the barrier ribs 26 and excited by ultraviolet rays. The first fluorescent material 28*a* emits red (R) light, the second fluorescent material 28*b* emits green (G) light, and the third fluorescent material 28*c* emits blue (B) light.

After sealing the front glass substrate 10 to the rear glass substrate 12, unnecessary gas is evacuated from a gap therebetween, and then a plasma forming gas is injected into the gap. Although a single gas (for example, neon (Ne)) can be used as the plasma forming gas, a mixed gas (for example, Ne+Xe) is widely used.

In this conventional PDP, a pressure of the plasma forming gas (a partial pressure of a particular gas in a case of a mixed gas) needs to be maintained at a high level in order to avoid an increase in a sputter rate (SR) on the surface of the protective layer 20, and thus a high discharge voltage is required.

More specifically, referring to paschen curves G1 and G2 shown in FIG. 3, a discharge voltage can be lowered by adjusting a pressure P of a plasma forming gas and a gap "d" between the first and second sustain electrodes 14*a* and 14*b* such that a product Pd of the pressure P and the gap "d" is 1. For example, when the gap "d" is 100 μm (i.e., 0.01 cm), if the pressure P is maintained at 100 torr, a discharge voltage of a PDP can be lowered.

However, when the pressure P of a plasma forming gas is lowered, an SR on the surface of the protective layer 20 rapidly increases according to Formula (1), which defines the SR.

$$SR=(j/P)^{2.5} \quad (1)$$

Where, "j" is an electric current density of the surfaces of the sustain electrodes 14*a* and 14*b*.

For this reason, in the conventional PDP, the pressures of a plasma forming gas must be maintained at a high level (e.g., 300–500 torr), and thus a discharge voltage is also high.

SUMMARY OF THE INVENTION

The present invention provides a plasma display panel (PDP) having a lowered discharge voltage and a maintained efficiency.

The present invention also provides a method of manufacturing the PDP.

According to an aspect of the present invention, there is provided a PDP including a front panel on which an image is displayed, the front panel comprising a plurality of sustain electrodes, a plurality of bus electrodes, a first dielectric layer covering both the plurality of sustain electrodes and the bus electrodes, and a protective layer; a rear panel separated from the front panel and hermetically sealed to the front panel, the rear panel comprising a plurality of data lines, a second dielectric layer covering the plurality of data lines, a plurality of barrier ribs, and a fluorescent layer; and a plasma forming gas arranged between the front and rear panels. A first sustain electrode selected from the plurality of sustain electrodes and a second sustain electrode facing the first sustain electrode have a double gap, thereby allowing a discharge voltage to be decreased without reducing discharge efficiency, and allowing a discharge to be started at a low voltage, and allowing the low voltage discharge to stop after the start of the sustaining discharge.

Preferably, the first sustain electrode comprises a first main electrode used to sustain a discharge after the discharge is started, and a first auxiliary electrode connected to the first main electrode and used to start the discharge. The first auxiliary electrode is a resistance element having a resistance of at least 30 Ω. Preferably, the second sustain electrode comprise a second main electrode used to sustain a discharge after the low voltage discharge is started, and a second auxiliary electrode connected to the second main electrode and used to start the low voltage discharge. The second auxiliary electrode is a resistance element having a resistance of at least 30 Ω.

Preferably, a first groove, in which the first auxiliary electrode is disposed, is formed in the first main electrode, and a second groove, in which the second auxiliary electrode is disposed, is formed in the second main electrode.

Preferably, at least one of the first and second grooves is near one of the plurality of barrier ribs.

Preferably, an entrance of at least one of the first and second grooves is narrower than the inside thereof.

Preferably, the first auxiliary electrode comprises a body disposed within the first groove, and an end portion extending from the body and disposed between the first and second sustain electrodes. Preferably, the second auxiliary electrode has the same structure as the first auxiliary electrode.

Preferably, the end portion of the first auxiliary electrode is parallel with or perpendicular to a bus electrode formed on the first sustain electrode to be parallel with the first sustain electrode or has a pointed shape. Preferably, the end portion of the second auxiliary electrode is parallel with or perpendicular to a bus electrode formed on the second sustain electrode to be parallel with the second sustain electrode or has a pointed shape.

Preferably, the first and second grooves are vertically or diagonally symmetrical.

Preferably, the first auxiliary electrode is a resistance element provided at an end of the first main electrode to face the second sustain electrode.

Preferably, the second auxiliary electrode is a resistance element provided at an end of the second main electrode to face the first sustain electrode.

Preferably, the first auxiliary electrode is a resistance element provided at an end of the first main electrode to face the second sustain electrode or the second auxiliary electrode.

Preferably, the plasma forming gas is a mixed gas of neon (Ne) and xenon (Xe) and contains 4–20 mole % Xe.

Preferably, the front panel further comprises a ditch formed above the first auxiliary electrode or the first and second auxiliary electrodes in the first dielectric layer. The first dielectric layer can comprise upper and lower dielectric layers having different dielectric constants, and the ditch is formed to expose the lower dielectric layer lying below the upper dielectric layer.

The first and/or second groove can be formed immediately above one of the plurality of barrier ribs.

According to another aspect of the present invention, there is provided a PDP including a front panel on which an image is displayed, the front panel comprising a plurality of sustain electrodes, a plurality of bus electrodes, a first dielectric layer covering the plurality of sustain electrodes and bus electrodes, and a protective layer; a rear panel separated from the front panel and hermetically sealed to the front panel, the rear panel comprising a plurality of data lines, a second dielectric layer covering the plurality of data lines, a plurality of barrier ribs, and a fluorescent layer; and a plasma forming gas arranged between the front and rear panels. At least one of the plurality of sustain electrodes comprises a main electrode used to sustain discharge, and an auxiliary electrode having a high resistance and used to start the discharge. The auxiliary electrode is connected to the main electrode such that at least part of the auxiliary electrode exists between two facing sustain electrodes.

Preferably, the auxiliary electrode is connected to an end of the main electrode such that the entire auxiliary electrode is disposed between the two facing sustain electrodes.

A ditch can be formed to a predetermined depth in the first dielectric layer immediately above the auxiliary electrode. The first dielectric layer can be formed by sequentially forming lower and upper dielectric layers having different dielectric constants, and the ditch is formed to expose the lower dielectric layer lying below the upper dielectric layer.

Preferably, a groove in which the auxiliary electrode is disposed is formed in the main electrode. The groove can be formed immediately above one of the plurality of barrier ribs.

According to still another aspect of the present invention, there is provided a method of manufacturing a PDP including a front panel having a front glass substrate, a plurality of sustain electrodes, a plurality of bus electrodes, and a first dielectric layer covering the plurality of sustain electrodes and bus electrodes, and a protective layer; a rear panel separated from the front panel and hermetically sealed to the front panel, the rear panel having a rear glass substrate, a plurality of data lines, a second dielectric layer covering the plurality of data lines, a plurality of barrier ribs, and a fluorescent layer; and a plasma forming gas arranged between the front and rear panels. The method comprises forming the sustain electrodes such that each sustain electrode faces another sustain electrode with a double gap allowing discharge to be started at a low voltage without decreasing discharge efficiency between the two facing sustain electrodes and allowing low-voltage discharge to stop after the start of the sustaining discharge.

Preferably, forming the sustain electrodes having the double gap therebetween comprises forming a transparent electrode material layer for forming the sustain electrodes on a surface of the front glass substrate, which faces the rear glass substrate panel, depositing a photoresist layer on the transparent electrode material layer, patterning the photoresist layer to have the same pattern as the sustain electrodes, thereby forming a photoresist layer pattern having a double gap, etching the transparent electrode material layer using the photoresist layer pattern as an etch mask, and removing the photoresist layer pattern.

Preferably, at least one of the two facing sustain electrodes is formed to comprise a main electrode used to sustain a discharge after the discharge is started, and an auxiliary electrode having a high resistance and used to start the low voltage discharge. The main and auxiliary electrodes can be integrally and simultaneously formed. Preferably, a groove is formed in the main electrode, and the auxiliary electrode is formed in the groove. Preferably, the auxiliary electrode is formed at an end of the main electrode such that the auxiliary electrode is disposed between the two facing sustain electrodes. Preferably, the auxiliary electrode comprises a body formed within the groove, and an end portion extended from the body out of the groove to be disposed between the two facing sustain electrodes. The body has a serpentine shape in a horizontal plane or a vertical plane. Preferably, the end portion is parallel with or perpendicular to bus electrodes formed on the two facing sustain electrodes, respectively, or has a pointed shape. Preferably, an entrance of the groove is narrower than the inside of the groove. Preferably, the auxiliary electrode is formed in each of the two facing sustain electrodes such that the auxiliary electrodes in the respective two facing sustain electrodes are vertically or diagonally symmetrical.

Preferably, the method further comprises forming a ditch in the first dielectric layer immediately above the double gap. The first dielectric layer can be formed by sequentially stacking a lower dielectric layer and an upper dielectric layer having different dielectric constants, and the ditch is formed to expose the lower dielectric layer lying below the upper dielectric layer.

The groove can be formed immediately above one of the plurality of barrier ribs.

According to the present invention, a pressure (partial pressure) of a plasma forming gas used in a PDP is maintained at a high level, like in the conventional PDP, and a discharge voltage is remarkably lowered as compared to that of the conventional PDP.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
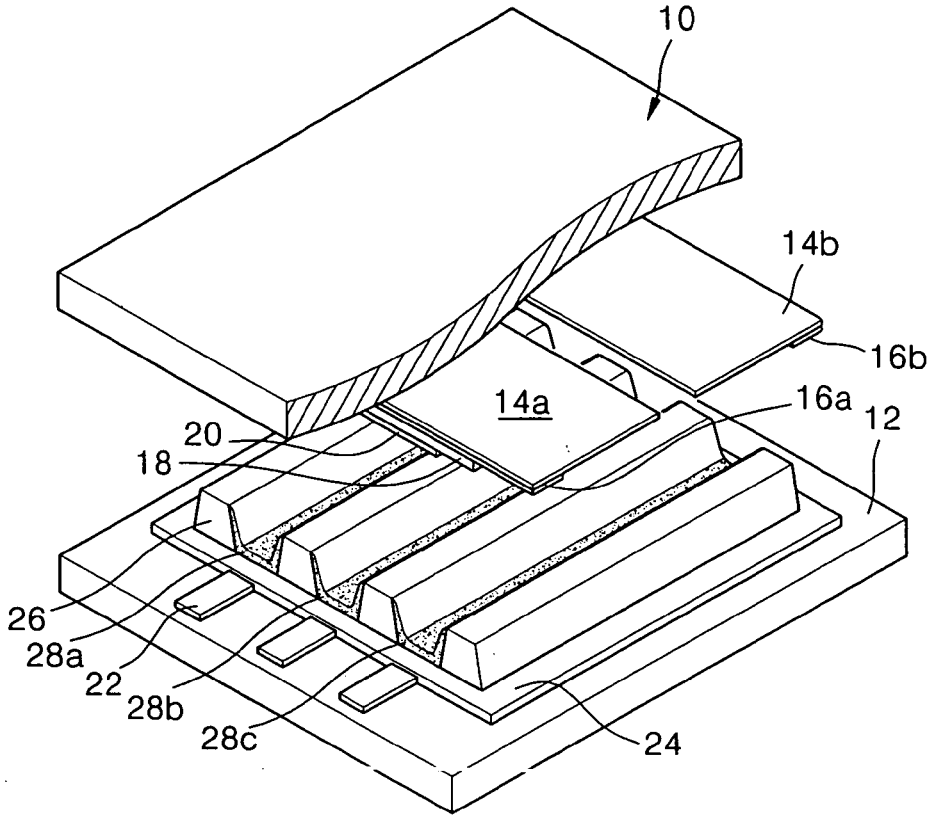
FIG. 1 (PRIOR ART)
FIG. 1 is a perspective view of a conventional plasma display panel (PDP)

Hereinafter, embodiments of the present invention will be described in detail with reference to the attached drawings. In the drawings, the thickness of layers and regions are exaggerated for clarity.

Figure 3:
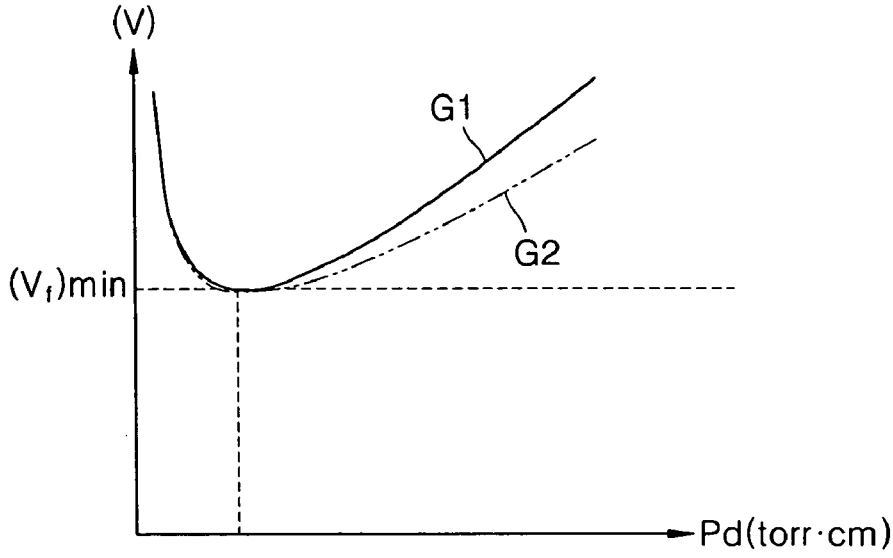
FIG. 3 is a graph of paschen curves showing changes in a discharge voltage with respect to a gap between sustain electrodes and a pressure of a plasma forming gas in a PDP.

In FIG. 3, a reference character G1 denotes a first paschen curve obtained when a plasma forming gas is composed of a single component, and a reference character G2 denotes a second paschen curve obtained when a plasma forming gas is a mixed gas.

Referring to the first and second paschen curves G1 and G2, it can be inferred that when a plasma forming gas is a mixed gas, as well as when it is a single gas, a voltage when a product Pd of a pressure P of a plasma forming gas (hereinafter, referred to as a gas pressure P) and a gap "d" between sustain electrodes is 1 is a minimum discharge start voltage $(V_f)$min.

A discharge start voltage $V_f$ is given by Formula (2).

$$V_f = \frac{BPd}{K + \ln Pd} \tag{2}$$

Where B is a constant, and K is given by Formula (3).

$$K = \ln\left[\frac{A}{\ln\left(1 + \frac{1}{\gamma}\right)}\right] \tag{3}$$

Where γ is a secondary electron emission coefficient, which is determined in accordance with a material of the sustain electrodes.

A minimum Pd value $Pd_{min}$ and the minimum discharge start voltage $(V_f)$min are given by Formulae (4) and (5), respectively.

$$Pd_{\min} = \frac{e}{A}\ln\left(1 + \frac{1}{\gamma}\right) \tag{4}$$

Where "e" is a natural logarithm, and A is a constant.

$$(V_f)_{\min} = e\frac{B}{A}\ln\left(1 + \frac{1}{\gamma}\right) \tag{5}$$

Generally, the condition Pd=1 is satisfied by decreasing the gap "d" between sustain electrodes and increasing the gas pressure P or by increasing the gap "d" and decreasing the gas pressure P.

When decreasing the gap "d" between sustain electrodes and increasing the gas pressure P, a sputter rate (SR) at the surface of a protective layer (e.g., a MgO layer) can be decreased according to Formula (1) because the gas pressure P is high, but brightness or efficiency is rapidly decreased due to a decrease in the gap "d" between sustain electrodes.

Conversely, when increasing the gap "d" and decreasing the gas pressure P, the problem occurring in the above situation can be overcome because the gap "d" between sustain electrode is wide, but the SR at the surface of the protective layer rapidly increases because the gas pressure P is low.

Accordingly, in conventional PDPs, the gas pressure P is set high and the gap "d" between sustain electrodes is set to a proper value, which prevents brightness or efficiency from excessively decreasing, in order to lower the SR at the surface of a protective layer. As a result, the PD value exceeds 1. For example, the PD value becomes 3 through 4. However, when the PD value exceeds 1, a discharge start voltage is greater than the minimum discharge start voltage $(V_f)$min, as shown in FIG. 3.

Accordingly, in order to lower the SR at the surface of a protective layer, the present invention provides a PDP including a sustain electrode for alleviating the problem, which occurs when the gap "d" between sustain electrodes decreases, by increasing the gas pressure P and decreasing the gap "d" between sustain electrodes and for maintaining the Pd value close to 1.

Since a PDP according to the present invention is characterized by a sustain electrode, the following description of the invention concentrates on a sustain electrode, and variously modified sustain electrodes, which can accomplish the objectives of the present invention.

Figure 4:
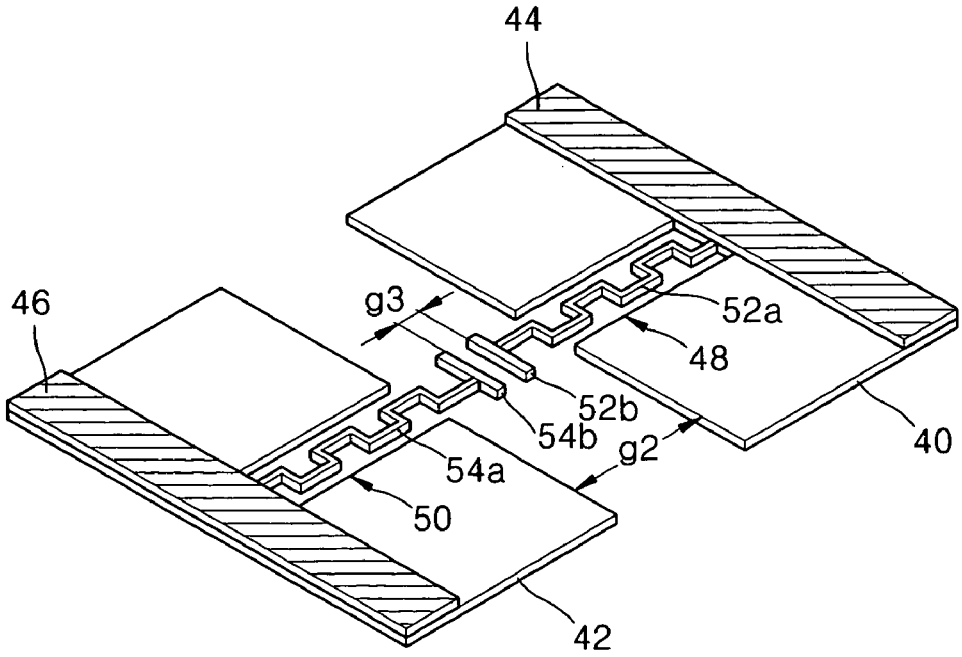
FIG. 4 is a perspective view of sustain electrodes having a double gap and bus electrodes formed on the sustain electrodes, respectively, in a PDP according to a first embodiment of the present invention.

A sustain electrode used in a PDP according to a first embodiment of the present invention will be described in detail with reference to FIG. 4. FIG. 4 is a perspective view of a structure, in which sustain electrodes are combined with bus electrodes in a PDP according to the first embodiment of the present invention, the structure viewed from the below of a front glass substrate.

In FIG. 4, reference numeral 40 and 42 denote first and second sustain electrodes, respectively, which are used to sustain a discharge after the start of the discharge. A predetermined gap g2 exists between the first and second sustain electrodes 40 and 42. Reference numerals 44 and 46 denote first and second bus electrodes, respectively, which are formed on the respective first and second sustain electrodes 40 and 42 in parallel with each other. The first and second bus electrodes 44 and 46 are parallel with the respective first and second sustain electrodes 40 and 42. A first groove 48 having a predetermined depth is formed in the first sustain electrode 40, and a second groove 50 having a predetermined depth is formed in the second sustain electrode 42. The first and second grooves 48 and 50 are positioned to face each other and preferably have the same depth. However, the depths of the first and second grooves 48 and 50 can be different. For example, while the first groove 48 is formed from the bottom of the first sustain electrode 42 to the right below of the first bus electrode 44, as shown in FIG. 4, the second groove 50 can be formed from the bottom of the second sustain electrode 42 to a certain position between the bottom of the second sustain electrode 42 and the second bus electrode 46. A first resistance element is formed in the first groove 48, and a second resistance element is formed in the second groove 50. The first resistance element is composed of a body 52*a*, of which one end is connected to the bottom of the first groove 48 and of which the other end extends out of the first groove 48, and an end portion 52*b*, which is connected to the other end of the body 52*a*. The body 52*a* of the first resistance element has a serpentine shape in a horizontal plane or a vertical plane. The first resistance element is a part of the first sustain electrode 40 and is integrated therewith. The first resistance element is formed to be parallel with the first sustain electrode 40. The first resistance element is connected to the bottom of the first groove 48 and extends out of the first sustain electrode 40 toward the second sustain electrode 42, spaced a predetermined distance apart from both sides of the first groove 48. Accordingly, the end portion 52*b* of the first resistance element is positioned between the first and second sustain electrodes 40 and 42. Consequently, the first resistance element is closer to the second sustain electrode 42 than to the first sustain electrode 40. The first resistance element is formed while the first groove 48 is formed in the first sustain electrode 40, so the body 52*a* is parallel with the first sustain electrode 40. For the same reason, the end portion 52*b* of the first resistance element is parallel with the first sustain electrode 40. However, the end portion 52*b* is perpendicularly connected to the body 52*a* and thus parallel with the bottom of the first groove 48 or a side of the first sustain electrode 40 that faces the second sustain electrode 42. The end portion 52*b* has a predetermined length. It is preferable that the first resistance element is made of the same material as the first sustain electrode 40. However, the first resistance element can be made of a different material from the first sustain electrode 40, when necessary.

The structure and details of the second resistance element formed in the second groove 50 are the same as those of the first resistance element, and thus detailed description thereof will be omitted.

Like the first resistance element, the second resistance element is composed of a body 54*a* and an end portion 54*b*. The end portion 54*b* of the second resistance element is positioned between the first and second sustain electrodes 40 and 42 and is parallel with the end portion 52*b* of the first resistance element. As shown in FIG. 4, since the end portions 52*b* and 54*b* are positioned between the first and second sustain electrodes 40 and 42, a gap g3 between the end portions 52*b* and 54*b* is less than a gap g2 between the first and second sustain electrodes 40 and 42 (g3<g2). Consequently, a double gap exists between the first and second sustain electrodes 40 and 42.

As described above, since the gap g3 between the first and second resistance elements is less than the gap g2 between the first and second sustain electrodes 40 and 42, a discharge start voltage in a PDP according to the present invention is lowered compared to the conventional PDP. Since the first and second resistance elements have much greater resistance than the first and second sustain electrodes 40 and 42, immediately after the start of a discharge, current is supplied mostly through the first and second sustain electrodes 40 and 42 except for the first and second resistance element. As a result, a discharge having started between the first and second resistance element is spread between the first and second sustain electrodes 40 and 42. The discharge spread between the first and second sustain electrodes 40 and 42 is sustained at the same voltage as the discharge start voltage. When wall charges are used, a sustain voltage can be sustained lower than the discharge start voltage.

Simulations of the following two cases were carried out in order to prove the theory that a discharge start voltage decreases when a PDP is provided with the first and second sustain electrodes 40 and 42 shown in FIG. 4. The simulations will be later described in detail.

It is preferable that the percentage of Xe in the mixed gas of Ne and Xe is 4–22 mole % in a PDP according to embodiments of the present invention.

The following description concerns sustain electrodes, which are used in a PDP having the above-described characteristics according to second through ninth embodiments of the present invention.

While the sustain electrodes 40 and 42 in a PDP according to the first embodiment of the present invention are illustrated in three dimensions in FIG. 4, the sustain electrodes in PDPs according to the second through ninth embodiments of the present invention are illustrated in two dimensions, that is, they are illustrated on a plane. Sustain electrodes in PDPs of the second through ninth embodiments of the present invention are based on the sustain electrodes 40 and 42, as shown in FIG. 4, in a PDP of the first embodiment. Although the sustain electrodes in the second through ninth embodiments are illustrated on a plane, their three-dimensional shapes can be easily inferred with reference to FIG. 4.

In FIGS. 4 through 11, the same reference numeral denotes the same members.

Figure 5:
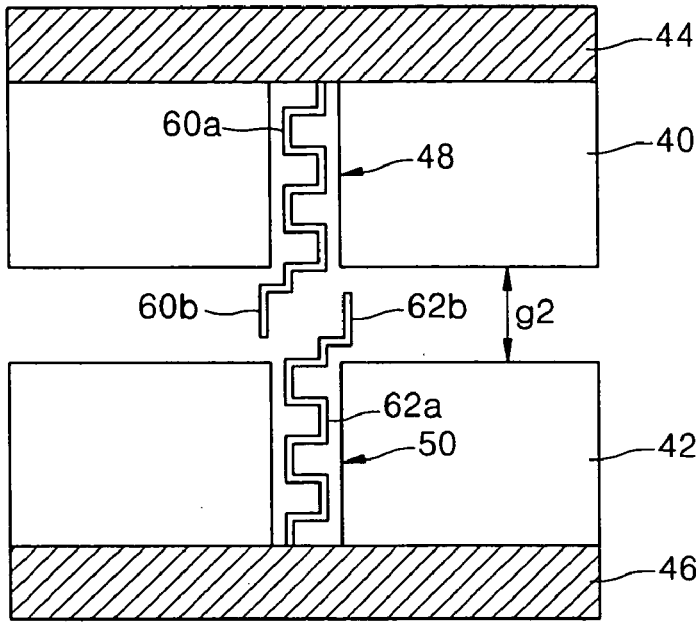
FIGS. 5 through 12 are plane views of sustain electrodes having a double gap and bus electrodes formed on the sustain electrodes, respectively, in PDPs according to second through ninth embodiments, respectively, of the present invention.

Referring to FIG. 5, the first and second sustain electrodes 40 and 42 used in a PDP according to the second embodiment of the present invention include a third resistance element in the first groove 48 and a fourth resistance element in the second groove 50, respectively. The third resistance element is composed of a body 60*a* and an end portion 60*b* extending out of the first groove 48. The fourth resistance element is also composed of a body 62*a* and an end portion 62*b*.

In comparison of FIGS. 4 and 5, the bodies 60*a* and 62*a* of the respective third and fourth resistance elements are the same as the body 52*a* of the first resistance element, but the end portions 60*b* and 62*b* of the respective third and fourth resistance elements are different from the end portion 52*b* of the first resistance element.

More specifically, the end portion 60*b* of the third resistance element is parallel with the end portion 62*b* of the fourth resistance element between the first and second sustain electrodes 40 and 42. However, the end portions 60*b* and 62*b* are parallel with each other in a direction perpendicular to the end portions 52*b* and 54*b* of the respective first and second resistance elements so that the end portions 60*b* and 62*b* are parallel with the sides of the first and second grooves 48 and 50. In addition, the end portion 60*b* of the third resistance element is positioned on one side of the first groove 48, and the end portion 62*b* of the fourth resistance element is positioned on the other side of the first groove 48, so that the end portions 60*b* and 62*b* face each other. The end portions 60*b* and 62*b* have a predetermined length, which is preferably less than the gap g2 between the first and second sustain electrodes 40 and 42. In addition, it is preferable that the end portion 60*b* of the third resistance element is possibly close to the second sustain electrode 42. For example, the end portion 60*b* of the third resistance element has a length of 20 μm through a length less than the gap g2 between the first and second sustain electrodes 40 and 42. It is also preferable that the end portion 62*b* of the fourth resistance element is possibly close to the first sustain electrode 40. It is more preferable that a horizontal gap between the end portions 60*b* and 62*b* is less than the gap g2 between the first and second sustain electrodes 40 and 42.

Figure 6:
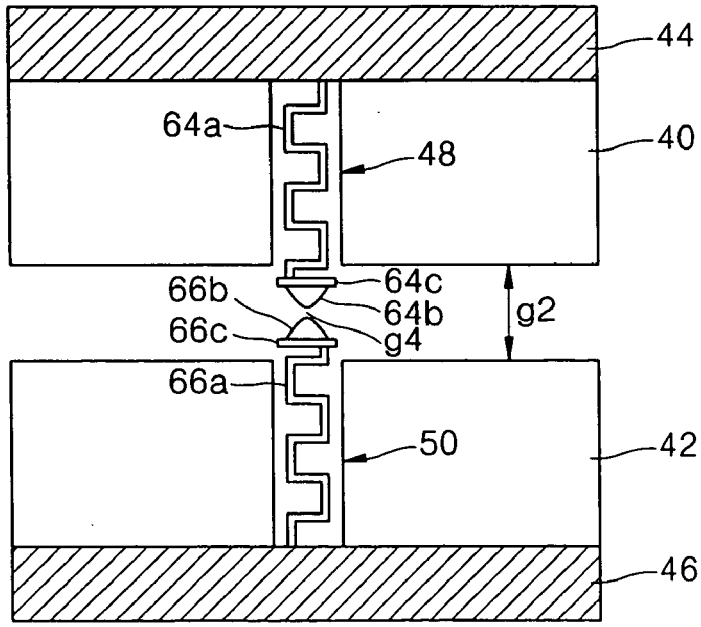

Referring to FIG. 6, the first and second sustain electrodes 40 and 42 used in a PDP according to the third embodiment of the present invention include a fifth resistance element in the first groove 48 and a sixth resistance element in the second groove 50, respectively. The fifth resistance element is composed of a body 64*a* and an end portion extending out of the first groove 48. The sixth resistance element is also composed of a body 66*a* and an end portion extending out of the second groove 50. The bodies 64*a* and 66*a* of the respective fifth and sixth resistance elements are the same as the body 52*a* of the first resistance element. The end portion of the fifth resistance element is composed of a horizontal part 64*c*, which is perpendicularly connected to the body 64*a* and is parallel with the bottom of the first groove 48, and a protrusion 64*b*, which has a pointed shape facing the sixth resistance element.

Likely the first through fourth resistance elements, the fifth resistance element is simultaneously formed while the first groove 48 is formed in the first sustain electrode 40, so the body 64, the horizontal part 64*c*, and the protrusion 64*b* are integrally formed. However, for clarity; these are distinguishably illustrated in FIG. 6.

The end portions of the respective fifth and sixth resistance elements are vertically symmetric. A horizontal part 66*c* of the sixth resistance element corresponds to the horizontal part 64*c* of the fifth resistance element, and a protrusion 66*b* corresponds to the protrusion 64*b*. A predetermined gap g4 exists between the protrusions 64*b* and 66*b*. It is preferable that the gap g4 between the protrusions 64*b* and 66*b* is less than the gap g2 between the first and second sustain electrodes 40 and 42. For example, the gap g4 is preferably about 20 μm and appropriately about 40 μm.

Figure 7:
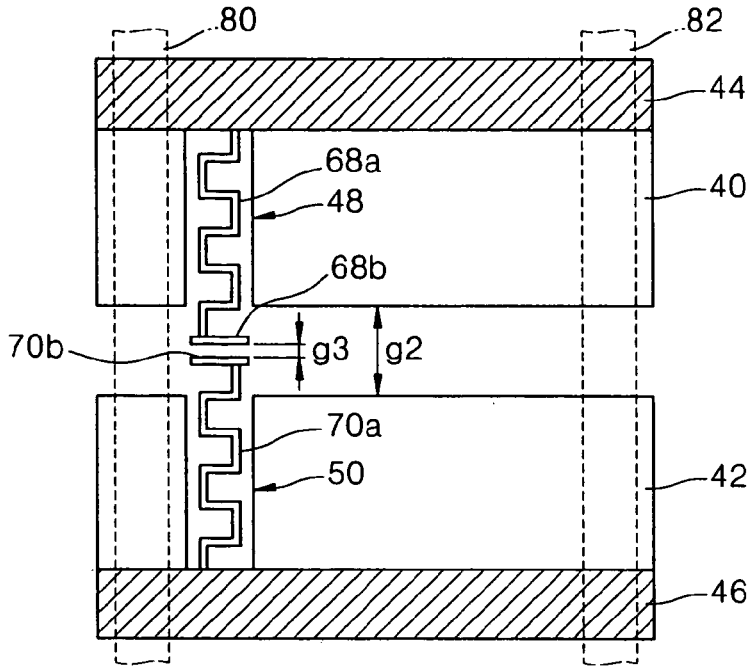

Referring to FIG. 7, the first and second sustain electrodes 40 and 42 used in a PDP according to the fourth embodiment of the present invention include the first and second grooves 48 and 50, respectively, on one sides, not at the centers like in the first through third embodiments.

More specifically, in FIG. 7, reference numerals 80 and 82 denote first and second barrier ribs, which are formed on a rear glass substrate (12 in FIG. 1) and define a cell within a pixel. The first and second grooves 48 and 50 included in the first and second sustain electrodes 40 and 42, respectively, are positioned near the first barrier rib 80. A seventh resistance element is integrally formed with the first sustain electrode 40 in the first groove 48, and an eighth resistance element is integrally formed with the second sustain electrode 42 in the second groove 50. The seventh and eighth resistance elements are the same as the first and second resistance elements, respectively. Accordingly, a body 68*a* and an end portion 68*b* of the seventh resistance element correspond to the body 52*a* and the end portion 52*b* of the first resistance element, and a body 70*a* and an end portion 70*b* of the eighth resistance element correspond to the body 54*a* and the end portion 54*b* of the second resistance element.

Figure 8:
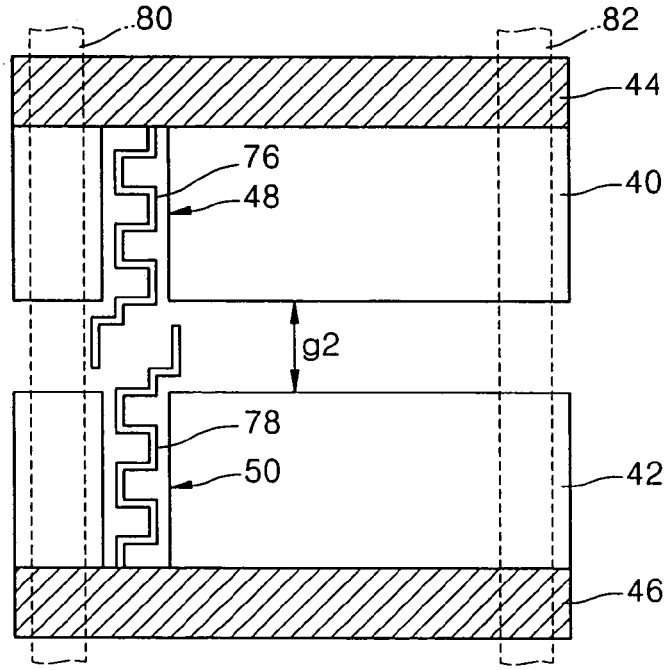

Referring to FIG. 8, like in the fourth embodiment, the first and second sustain electrodes 40 and 42 used in a PDP according to the fifth embodiment of the present invention include the first and second groove 48 and 50, respectively, near the first barrier rib 80. Ninth and tenth resistance elements 76 and 78 are formed in the first and second grooves 48 and 50, respectively. The ninth and tenth resistance elements 76 and 78 are the same as the third and fourth resistance elements, respectively, described in the second embodiment. Other features of the fifth embodiment are the same as those of the fourth embodiment.

Figure 9:
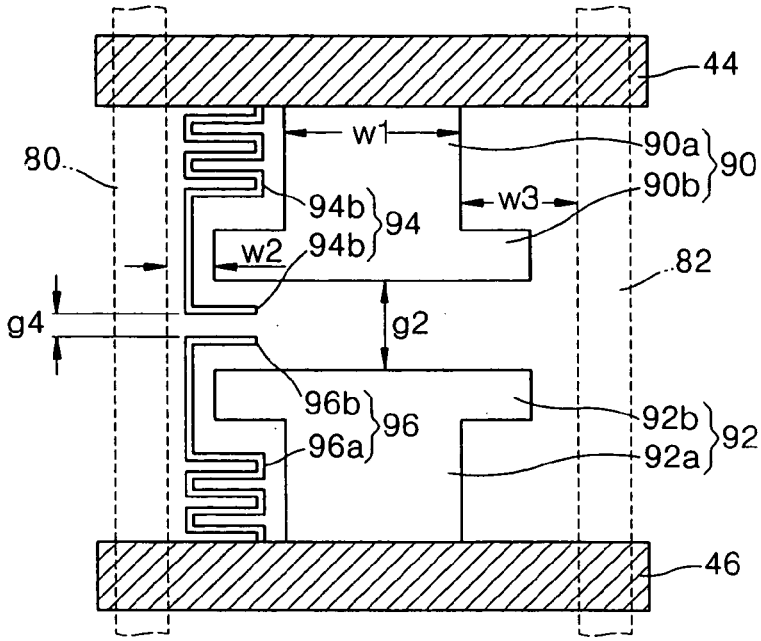

FIG. 9 shows third and fourth sustain electrodes 90 and 92 used in a PDP according to the sixth embodiment of the present invention. Referring to FIG. 9, the third and fourth sustain electrodes 90 and 92 are different from the first and second sustain electrodes 40 and 42 described above.

More specifically, the third sustain electrode 90 is composed of a body 90*a* and protrusion 90*b* in an upside down T shape. The body 90*a* has a predetermined width w1 between the first and second barrier ribs 80 and 82 so that an enough space to form a resistance element therewithin exists between the body 90*a* and each of the first and second barrier ribs 80 and 82. The protrusion 90*b* is extended from an end of the body 90*a* facing the fourth sustain electrode 92 in opposite directions to be parallel with the first bus electrode 44. The protrusion 90*b* is separated from each or the first and second barrier ribs 80 and 82 by a predetermined gap w2, which is less than a gap w3 between the body and each of the first and second barrier ribs 80 and 82. The fourth sustain electrode 92 is formed to face the third sustain electrode 90. The predetermined gap g2 exists between the third and fourth sustain electrodes 90 and 92. The fourth sustain electrode 92 is composed of a body 92*a* and protrusion 92*b* in a T shape. The third and fourth sustain electrodes 90 and 92 are vertically symmetric. Accordingly, a width of the body 92*a* of the fourth sustain electrode 92 is the same as the width w1 of the body 90*a* of the third sustain electrode 90. A gap between the body 92 and each of the first and second barrier ribs 80 and 82 is the same as the gap w3 between the body 90*a* and each of the first and second barrier ribs 80 and 82. In addition, a gap between the protrusion 92*b* of the fourth sustain electrode 92 and each of the first and second barrier ribs 80 and 82 is the same as the gap w2 between the protrusion 90*b* of the third sustain electrode 90 and each of the first and second barrier ribs 80 and 82. An eleventh resistance element 94 is composed of a body 94*a* and an end portion 94*b* and is integrally formed with the third sustain electrode 90 between the third sustain electrode 90 and the first barrier rib 80. A twelfth resistance element 96 is composed of a body 96*a* and an end portion 96*b* and is integrally formed with the fourth sustain electrode 92 between the fourth sustain electrode 92 and the first barrier rib 80. The eleventh resistance element 94 can be disposed between the third sustain electrode 90 and the second barrier rib 82. The twelfth resistance element 96 can be disposed between the fourth sustain electrode 92 and the second barrier rib 82. The body 94*a* of the eleventh resistance element 94 is disposed between the body 90*a* of the third sustain electrode 90 and the first barrier rib 80. The end portion 94*b* of the eleventh resistance element 94 is extended from the body 94*a*, runs through a space between the first barrier rib 80 and the protrusion 90*b* of the third sustain electrode 90 and is extended between the third and fourth sustain electrodes 90 and 92. The end portion 94*b* is parallel with the protrusion 90*b* of the third sustain electrode 90. The eleventh and twelfth resistance elements 94 and 96 are vertically symmetric. Accordingly, the end portion 96*b* of the twelfth resistance element 96 is parallel with the end portion 94*b* of the eleventh resistance element 94 between the third and fourth sustain electrodes 90 and 92. As a result, the gap g4 between the end portion 94*b* of the eleventh resistance element and the end portion 96*b* of the twelfth resistance element is less than the gap g2 between the third and fourth sustain electrodes.

Figure 10:
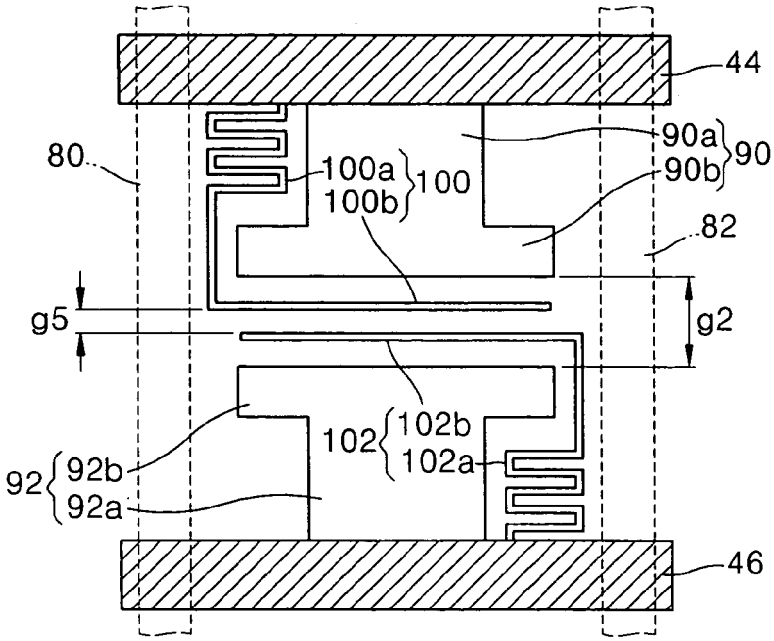

Referring to FIG. 10, in a PDP according to the seventh embodiment of the present invention, the third and fourth sustain electrodes 90 and 92 are used as main electrodes, and thirteenth and fourteenth resistance elements 100 and 102 are used as auxiliary electrodes. The thirteenth resistance element 100 is composed of a body 100*a* and an end portion 100*b* and is integrally formed with the third sustain electrode 90 between the first barrier rib 80 and the third sustain electrode 90. The fourteenth resistance element 102 is composed of a body 102*a* and an end portion 102*b* and is integrally formed with the fourth sustain electrode 92 between the second barrier rib 82 and the fourth sustain electrode 92. The body 100*a* of the thirteenth resistance element 100 has a serpentine shape in a horizontal plane or a vertical plane and is parallel with the third sustain electrode 90. One end of the body 100*a* is connected to the third sustain electrode 90. The end portion 100*b* of the thirteenth resistance element 100 is extended from the other end of the body 100*a*, runs through a space between the protrusion 90*b* of the third sustain electrode 90 and the first barrier rib 80 and is extended between the third and fourth sustain electrodes 90 and 92. The end portion 100*b* of the thirteenth resistance element 100 is parallel with a side of the third sustain electrode 90, which faces the fourth sustain electrode 92. It is preferable that the length of the end portion 100*b* is the same of the length of the side of the third sustain electrode 90 that faces the fourth sustain electrode 92. The body 102*a* of the fourteenth resistance element 102 has a serpentine shape in a horizontal plane or a vertical plane and is parallel with the fourth sustain electrode 92. One end of the body 102*a* is connected to the fourth sustain electrode 92. The end portion 102*b* of the fourteenth resistance element 102 is extended from the other end of the body 102*a*, runs through a space between the protrusion 92*b* of the fourth sustain electrode 92 and the second barrier rib 82 and is extended between the third and fourth sustain electrodes 90 and 92. The fourteenth resistance element 102 can be disposed between the fourth sustain electrode 92 and the first barrier rib 80. It is preferable that the shape of the body 102*a* of the fourteenth resistance element 102 is the same as that of the body 100*a* of the thirteenth resistance element 100, but they can be different. The end portion 102*b* of the fourteenth resistance element 102 is parallel with the end portion 100*b* of the thirteenth resistance element 100. Since the end portions 100*b* and 102*b* of the respective thirteenth and fourteenth resistance elements 100 and 102 exist between the third and fourth sustain electrodes 90 and 92, a gap g5 between the two end portions 100*b* and 102*b* is less than the gap g2 between the third and fourth sustain electrodes 90 and 92.

Figure 11:
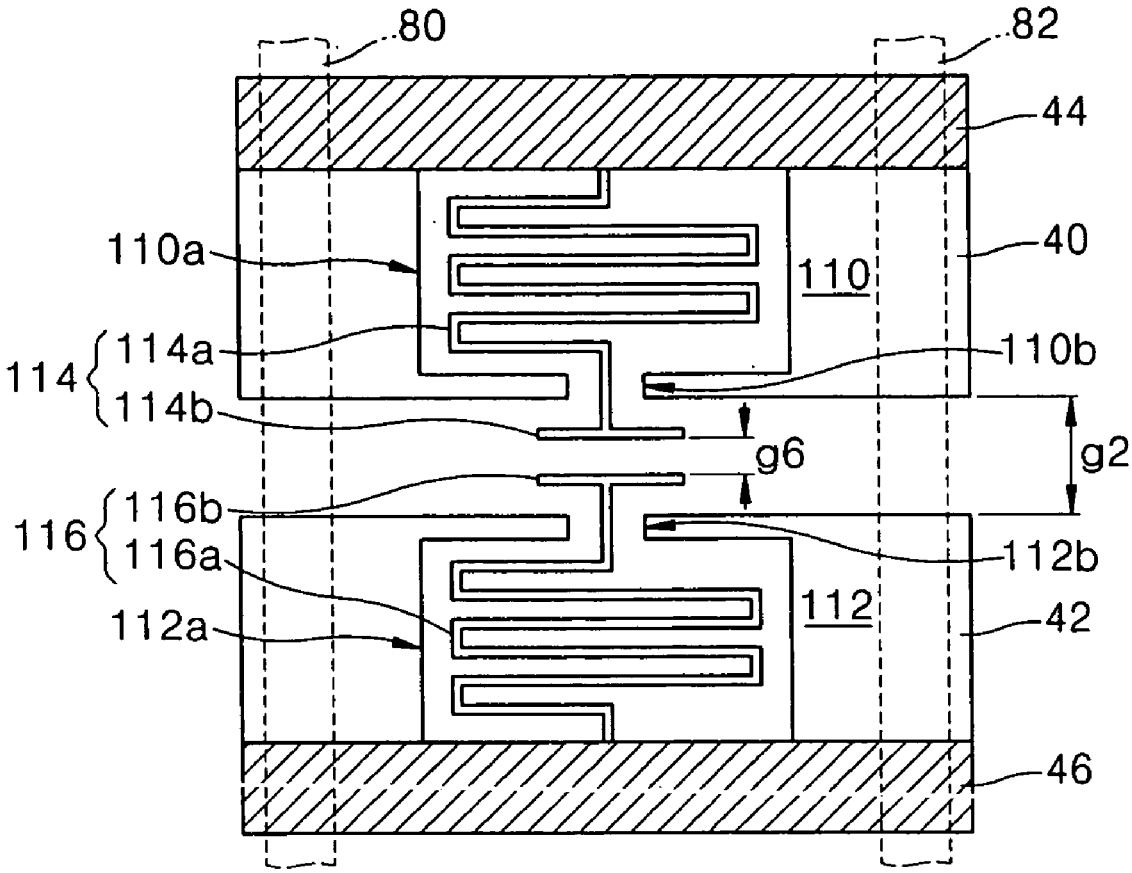

Referring to FIG. 11, in a PDP according to the eighth embodiment of the present invention, fifteenth and sixteenth resistance elements 114 and 116 are respectively disposed at the centers of fifth and sixth sustain electrodes 110 and 112 such that the fifth and sixth sustain electrodes 110 and 112 surround the fifteenth and sixteenth resistance elements 114 and 116, respectively.

More specifically, a third groove 110*a* is formed at the center of the fifth sustain electrode 110, and a fourth groove 112*a* is formed at the center of the sixth sustain electrode 112. Entrances 110*b* and 112*b* of the respective third and fourth grooves 110*a* and 112*a* are narrower than the third and fourth grooves 110*a* and 112*a*. The fifteenth and sixteenth resistance elements 114 and 116 exist in the third and fourth grooves 110*a* and 112*a*, respectively. The fifteenth resistance element 114 is composed of a body 114*a* and an end portion 114*b* extending out of the third groove 110*a*. The sixteenth resistance element 116 is composed of a body 116*a* and an end portion 116*b* extending out of the fourth groove 112*a*. The end portions 114*b* and 116*b* are parallel with each other between the fifth and sixth sustain electrodes 110 and 112 and also parallel with the fifth and sixth sustain electrodes 110 and 112. Since the end portions 114*b* and 116*b* exist between the fifth and sixth sustain electrodes 110 and 112, which are separated by the same gap as the gap g2 between the first and second sustain electrodes 40 and 42, a gap g6 between the end portions 114*b* and 116*b* is less than the gap g2 between the fifth and sixth sustain electrodes 110 and 112.

Figure 12:
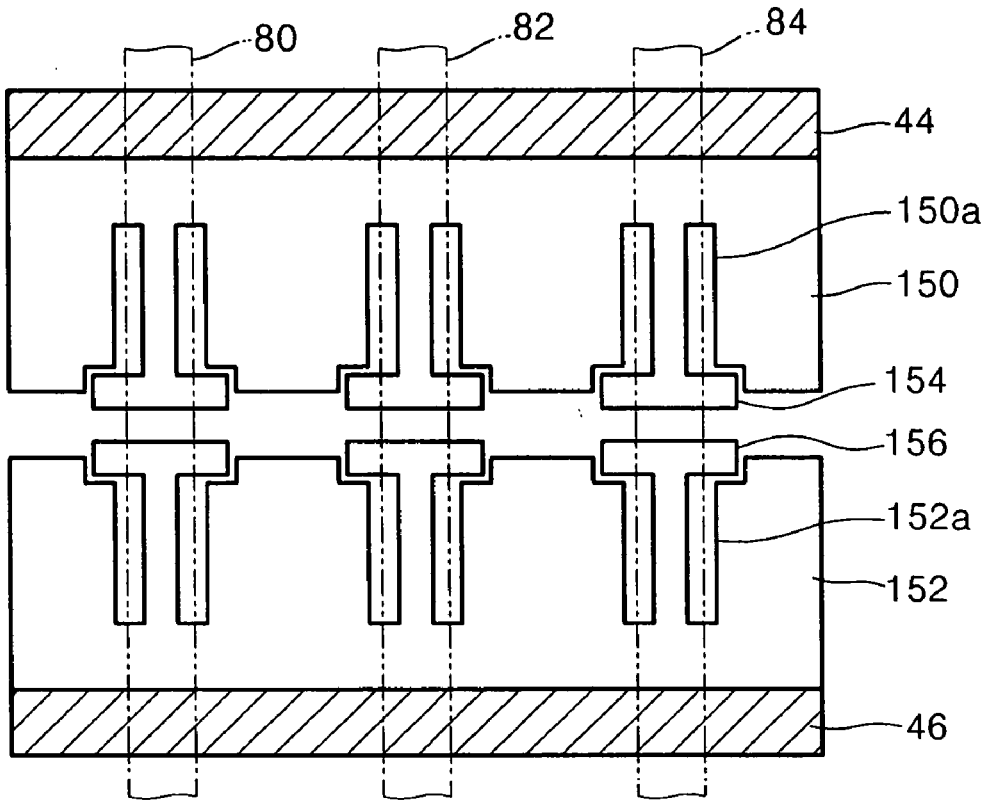

Referring to FIG. 12, a PDP according to the ninth embodiment of the present invention includes seventh and eighth sustain electrodes 150 and 152 as main electrodes which are spaced with a predetermined gap to be parallel with each other. The seventh sustain electrode 150 includes the first bus electrode 44, and the eighth sustain electrode 152 include the second bus electrode 46. The seventh sustain electrode 150 also includes a plurality of seventeenth resistance elements 154 as auxiliary electrodes. The eighth sustain electrode 152 also includes as many eighteenth resistance elements 156 as the number of the seventeenth resistance elements 154 as auxiliary electrodes. A gap between the resistance elements 154 or 156 in each of the seventh and eighth sustain electrodes is much wider than a gap between a seventeenth resistance element 154 and a corresponding eighteenth resistance element 156. The gap between the seventeenth and eighteenth resistance elements 154 and 156 is narrower than a gap between the seventh and eighth sustain electrodes 150 and 152. The seventh sustain electrode 150 includes fifth grooves 150*a* in which the seventeenth resistance elements 154 are respectively disposed to contact the bottoms of the fifth grooves 150*a*. Similarly, the eighth sustain electrode 152 includes sixth grooves 152*a* in which the eighteenth resistance elements 156 are respectively disposed to contact the bottoms of the sixth grooves 152*a*. Each of the seventeenth and eighteenth resistance elements 154 and 156 includes a horizontal part having a predetermined length and a vertical part having a predetermined length. The horizontal part of each seventeenth resistance element 154 is parallel with the horizontal part of a corresponding eighteenth resistance element 156. The gap between the seventeenth and eighteenth resistance elements 154 and 156 corresponds to a gap between the horizontal parts of the seventeenth and eighteenth resistance elements 154 and 156. In each of the resistance elements 154 and 156, one end of the vertical part is connected to the center of the horizontal part, and the other end of the vertical part is connected to the bottom of a corresponding groove. The horizontal parts of the respective seventeenth and eighteenth resistance elements 154 and 156 protrude from the ends of the seventh and eighth sustain electrodes 150 and 152 by a predetermined thickness. A step difference exists in the inner walls of the fifth and sixth grooves 150*a* and 152*a*. The step difference occurs because the width of the fifth and sixth grooves 150*a* and 152*a* is wider at the entrance thereof than at the inside thereof. The entrance of the fifth and sixth grooves 150*a* and 152*a* is wider than the inside thereof because the length of the horizontal parts of the seventeenth and eighteenth resistance elements 154 and 156 is greater than the diameter of the insides of the fifth and sixth grooves 150*a* and 152*a*. The vertical parts of the seventeenth and eighteenth resistance elements 154 and 156 are separated from the inner walls of the fifth and sixth grooves 150*a* and 152*a*. The seventeenth and eighteenth resistance elements 154 and 156 having the above-described characteristics correspondingly face first through third barrier ribs 80, 82, and 84 of the seventh and eighth sustain electrodes 150 and 152. In other words, the seventeenth and eighteenth resistance elements 154 and 156 are formed immediately above the first through third barrier ribs 80, 82, and 84.

In the above-described embodiments, it is preferable that a gap between a main electrode and an auxiliary electrode is 15 μm or less.

Figure 13:
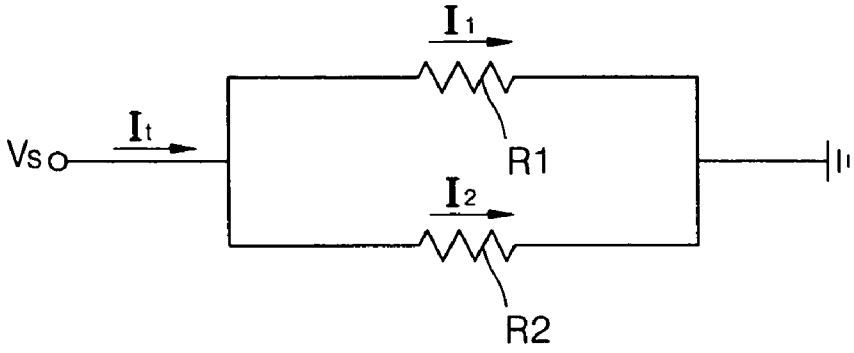
FIG. 13 is a circuit diagram of an equivalent circuit of each of the sustain electrodes having a double gap in a PDP, according to an embodiment of the present invention.

The shapes of various sustain electrodes described above in the embodiments of the present invention are different, but the sustain electrodes can be represented by an equivalent circuit, as shown in FIG. 13. In FIG. 13, a first resistance R1 denotes the resistance of the above-described resistance elements, and a second resistance R2 denotes the resistance of the first through sixth sustain electrodes 40, 42, 90, 92, 110, and 112. A reference character $I_t$ denotes a total of current, which is supplied to a sustain electrode including a resistance element, when a discharge start voltage Vs is applied. A reference character $I_1$ denotes current flowing across the first resistance R1, and a reference character $I_2$ denotes current flowing across the second resistance R2.

Referring to FIG. 4, which shows the first and second sustain electrodes 40 and 42 used in the PDP according to the first embodiment of the present invention, the first or second resistance element corresponds to the first resistance R1 in the equivalent circuit shown in FIG. 13, and the first or second sustain electrode 40 or 42 corresponds to the second resistance R2 in FIG. 13.

The currents $I_1$ and $I_2$ shown in FIG. 13 can be expressed by Formulae (6) and (7), respectively.

$$I_1 = \frac{R_2}{R_1 + R_2} I_t \tag{6}$$

$$I_2 = \frac{R_1}{R_1 + R_2} I_t \tag{7}$$

Accordingly, when appropriate values are given to the first and second resistances R1 and R2, the currents $I_1$ and $I_2$ flowing across the first and second resistances R1 and R2, respectively, can be obtained using Formulae (6) and (7).

For example, when the first resistance R1 is 1 kΩ and the second resistance R2 is 30 Ω, the current $I_1$ flowing across the first resistance R1 is $[30/(1000+30)]I_t$ according to Formula (6), and the current $I_2$ flowing across the second resistance R2 is $[1000/(1000+30)]I_t$ according to Formula (7). Consequently, a ratio of the current $I_1$ flowing across the first resistance R1 to the current $I_2$ flowing across the second resistance R2 is 3:100. The inference can be made from this fact that the current $I_1$ flowing across the first resistance R1, which is much greater than the second resistance R2, is much less than the current $I_2$ flowing across the second resistance R2.

This result is applied to the present invention, as it is. In other words, since the resistance of the various resistance elements is much greater than the resistance of the first through eighth sustain electrodes, current flowing across the various resistance elements is much less than current flowing across the first through eighth sustain electrodes.

Accordingly, after a discharge is started at a low voltage using the resistance elements, the flow of current is extremely restricted in the resistance elements, and most current flows through sustain electrodes, which have much less resistance than the resistance elements.

It has been described that resistance elements are provided in the first through eighth sustain electrodes, respectively. However, when considering the functions of the first through eighth sustain electrodes and the resistance elements, the first through eighth sustain electrodes can be regarded as first through eighth main electrodes, and the first through eighteenth resistance elements can be regarded as first through eighteenth auxiliary electrodes. In this situation, a sustain electrode according to the present invention is composed of a main electrode and an auxiliary electrode.

The following description concerns a PDP according to a tenth embodiment of the present invention. The PDP according to the tenth embodiment is different from the PDPs according to the first through ninth embodiments in that a ditch is formed on an upper plate of the PDP.

Figure 14:
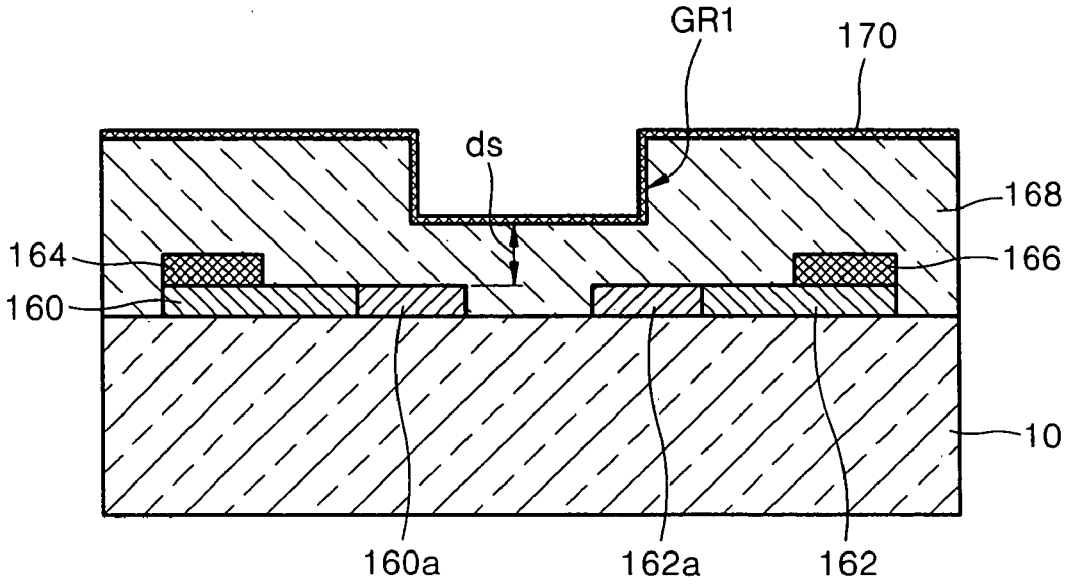
FIGS. 14 and 15 are cross-sections of characteristics of an upper plate including sustain electrodes and bus electrodes of a PDP according to a tenth embodiment of the present invention.

Referring to FIG. 14, ninth and tenth sustain electrodes 160 and 162 are spaced with a predetermined gap on the front glass substrate 10 to be parallel with each other. The ninth and tenth sustain electrodes 160 and 162 are main electrodes and equivalent to the sustain electrodes included in the PDPs according to the first through ninth embodiments. Third and fourth bus electrodes 164 and 166 are formed on the ninth and tenth sustain electrodes 160 and 162, respectively. The third and fourth bus electrodes 164 and 166 are formed at the same positions as and have the same functions as the first and second bus electrodes 44 and 46, respectively. Reference characters 160*a* and 162*a* denote auxiliary electrodes indicating nineteenth and twentieth resistance elements provided in the ninth and tenth sustain electrodes 160 and 162, respectively. The nineteenth and twentieth resistance elements 160*a* and 162*a* are equivalent to the resistance elements included in each of the PDPs according to the first through ninth embodiments. Thus, the shapes of the nineteenth and twentieth resistance elements 160*a* and 162*a* are schematically illustrated.

A dielectric layer 168 is formed to a predetermined thickness on the front glass substrate 10 so that the ninth and tenth sustain electrodes 160 and 162, the third and fourth bus electrodes 164 and 166, and the nineteenth and twentieth resistance elements 160*a* and 162*a* are covered with the dielectric layer 168. Preferably, the dielectric layer 168 transmits incident light. A first ditch GR1 is formed to a predetermined depth in the dielectric layer 168. Preferably, the first ditch GR1 is formed immediately above the nineteenth and twentieth resistance elements 160*a* and 162*a*. It is preferable that the first ditch GR1 is formed as deep as possible but it does not expose the nineteenth and twentieth resistance elements 160*a* and 162*a*. In other words, it is preferable that a gap between the bottom of the first ditch GR1 and the nineteenth and twentieth resistance elements 160*a* and 162*a* is minimized.

When the first ditch GR1 is formed in the dielectric layer 168, a discharge gas can exist in the first ditch GR1. Accordingly, a gap between the discharge gas and the nineteenth and twentieth resistance elements 160*a* and 162*a* is narrowed so that a discharge voltage is decreased compared to when the first ditch GR1 is not formed in the dielectric layer 168. In other words, since a gas in the first ditch GR1 has a lower dielectric constant than the dielectric layer 168, the intensity of an electric field in the first ditch GR1 is greater than other portions. Accordingly, discharge can be started with a lower discharge voltage in the first ditch GR1 than in the other portions. Since a pressure within the PDP and the discharge gas do not change, light emission efficiency does not decrease.

A protective layer 170 (made of MgO) is formed on the dielectric layer 168 to cover the surface of the first ditch GR1.

Figure 15:
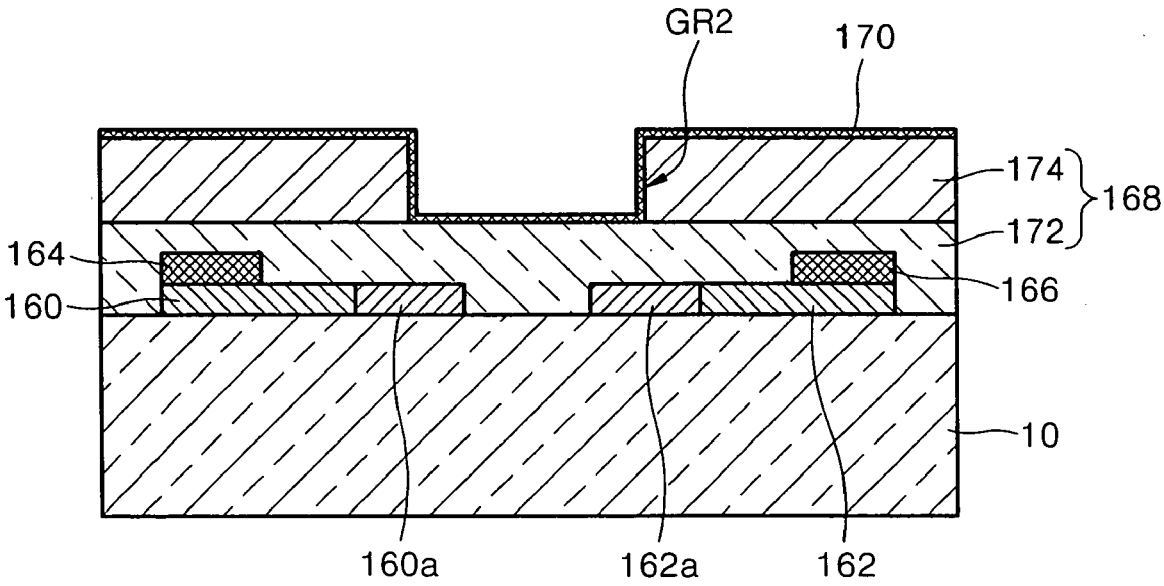

The dielectric layer 168 preferably includes a single layer but can include multiple layers. For example, as shown in FIG. 15, the transmissive dielectric layer 168 can include a first dielectric layer 172 and a second dielectric layer 174. It is preferable that the first and second dielectric layers 172 and 174 are transparent. Even when the dielectric layer 168 includes the first and second dielectric layers 172 and 174, a second ditch GR2 can be formed in the dielectric layer 168, as shown in FIG. 15. It is preferable that the second ditch GR2 is formed at the same position as the first ditch GR1. In addition, it is preferable that the second ditch GR2 pierces through the second dielectric layer 174 and exposes the first dielectric layer 172. It is preferable that the exposed portion of the first dielectric layer 172 is as thin as possible but the nineteenth and twentieth resistance elements 160*a* and 162*a* are not exposed. The protective layer 170 is formed on the second dielectric layer 174 to cover the surface of the second ditch GR2. It is preferable that the protective layer 170 is made of MgO, but the protective layer 170 can be made of another material having the same function as MgO.

To prove the superiority of a PDP according to the present invention to a conventional PDP, experiments were performed, and the results of the experiments are illustrated in FIGS. 16 through 19.

In the experiments, the PDP (hereinafter, referred to as a first PDP) according to the eighth embodiment of the present invention shown in FIG. 11, the PDP (hereinafter, referred to as a second PDP) according to the ninth embodiment of the present invention shown in FIG. 12, and the conventional PDP (hereinafter, referred to as a third PDP) shown in FIG. 1 were used. A mixture gas of Ne and Xe is used as a discharge gas.

To compare the characteristics of the first through third PDPs, the sustain voltage-efficiency characteristics (hereinafter, referred to as first characteristics) and the sustain voltage-brightness characteristics (hereinafter, referred to as second characteristics) of the first through third PDPs were measured.

Figure 16:
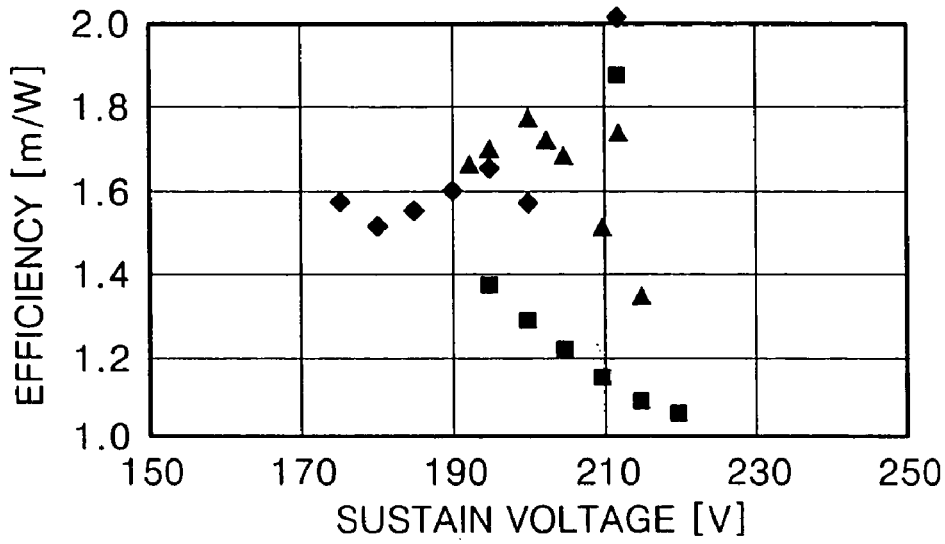
FIG. 16 is a graph of the results of experiments performed to compare PDP's sustain voltage-efficiency characteristics of conventional technology and an embodiment of the present invention.
Figure 17:
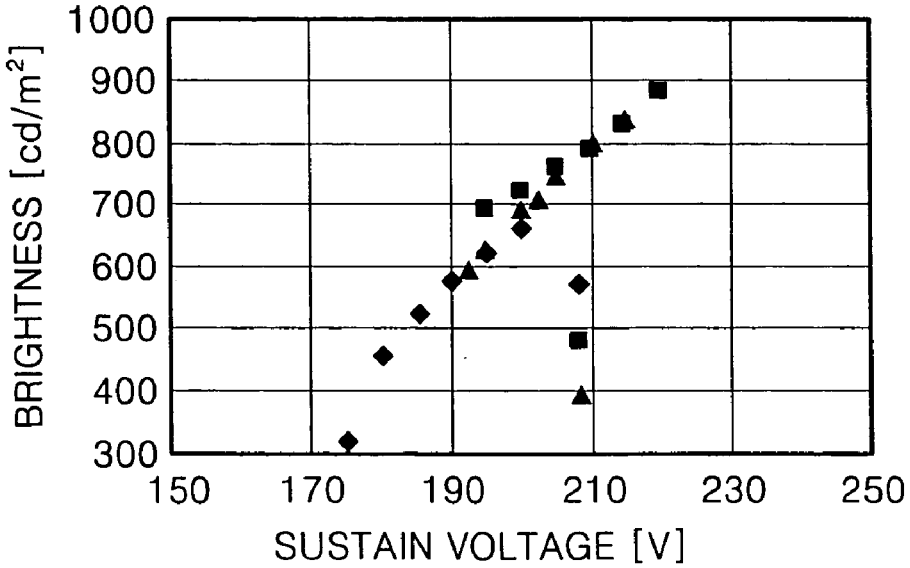
FIG. 17 is a graph of the results of experiments performed to compare PDP's sustain voltage-brightness characteristics of conventional technology and an embodiment of the present invention.

FIG. 16 shows the results of measuring the first characteristics of the first and third PDPs. FIG. 17 shows the results of measuring the second characteristics of the first and third PDPs.

In FIGS. 16 and 17, "▲" and "◆" denote cases where ratios of Xe to the discharge gas in the first PDP were 12% and 10%, respectively, and "■" denotes a case where a ratio of Xe to the discharge gas in the third PDP was 10%.

Referring to FIG. 16, a discharge start voltage was 195 V in the third PDP but 175 V in the first PDP including Xe of 10% in the discharge gas. In other words, the discharge start voltage in the first PDP is more than 10% lower than that in the third PDP.

In the meantime, to measure the first characteristics of the first and third PDPs in a stable discharge state, a sustain voltage was maintained at 205 V higher than the discharge start voltage by about 10 V in the third PDP while an efficiency (lm/W) of the third PDP was measured, and the Xe ratio was raised to 12% in the first PDP and then the efficiency of the first PDP was measured at a sustain voltage of 202.5 V. The efficiency of the third PDP was 1.210 lm/W while the efficiency of the first PDP was 1.722 lm/W at the Xe ratio of 12%. In other words, the efficiency of the first PDP was about 42% higher than that of the third PDP.

Referring to FIG. 17, when the Xe ratio was 12% in the first PDP, there was no big difference between the second characteristics of the first and third PDPs. However, when the Xe ratio was 10% in the first PDP, the brightness of the first PDP was lower than that of the third PDP.

It can be inferred from the results shown in FIGS. 16 and 17 that the first characteristic of the first PDP can be increased compared to the third PDP and the second characteristic of the first PDP is maintained at the level of the third PDP.

The following description concerns the results of measuring the first and second characteristics of the second and third PDPS. In measuring experiments, inner conditions such as a type of discharge gas, a discharge gas mixture ratio, an inner pressure, a duty ratio, and a type of fluorescent layer were the same in the second and third PDPs.

Figure 18:
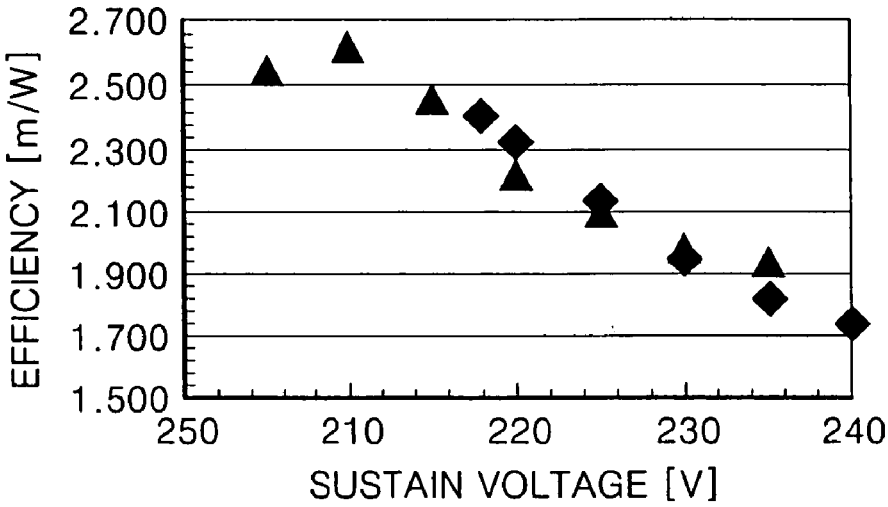
FIG. 18 is a graph of the results of experiments performed to compare PDP's sustain voltage-efficiency characteristics of conventional technology and the ninth embodiment of the present invention.
Figure 19:
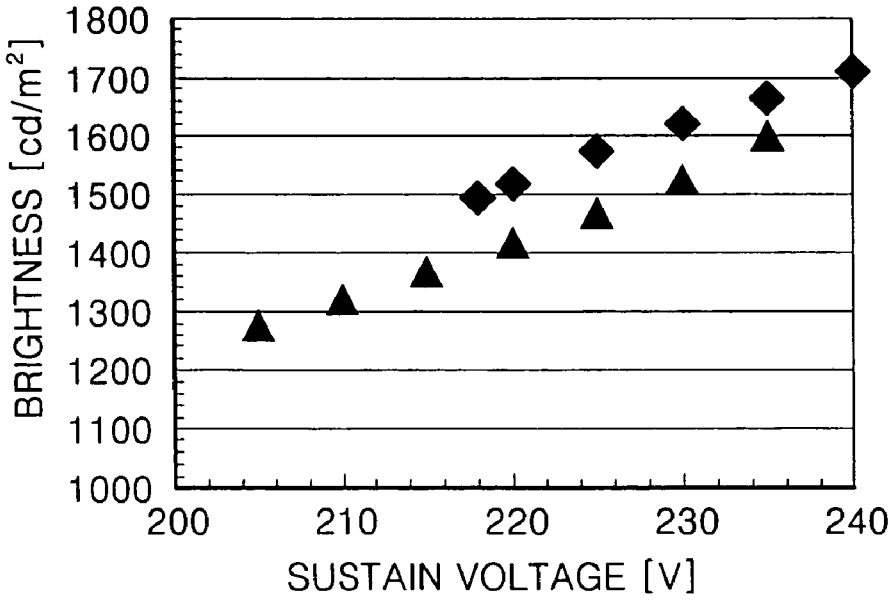
FIG. 19 is a graph of the results of experiments performed to compare PDP's sustain voltage-brightness characteristics of conventional technology and the ninth embodiment of the present invention.

FIG. 18 shows the results of measuring the first characteristics of the second and third PDPs. FIG. 19 shows the results of measuring the second characteristics of the second and third PDPs.

In FIG. 18, "▲" denotes the result of measuring the first characteristic of the second PDP, and "◆" denotes the result of measuring the first characteristic of the third PDP. In FIG. 19, "▲" denotes the result of measuring the second characteristic of the second PDP, and "◆" denotes the result of measuring the second characteristic of the third PDP.

Referring to FIG. 18, a discharge start voltage was 205 V in the second PDP but was 218 V in the third PDP. After the start of discharge, there was no big difference in light emission efficiency between the second and third PDPs. However, maximum light emission efficiency of the second PDP was higher than that of the third PDP at a sustain voltage lower than that in the third PDP.

Referring to FIG. 19, a discharge start voltage at which brightness in a visible area appears initially was much lower in the second PDP than in the third PDP. It can be inferred from the graph shown in FIG. 19 that the brightness of the third PDP is higher than that of the second PDP. However, it can also be inferred that the brightness of the second PDP can provide a satisfactory image to a user.

As described above, when the second characteristics of the second and third PDPs are considered synthetically, it can be concluded that the second characteristic of the second PDP is superior to that of the third PDP.

The following description concerns consumption power of the PDP having a ditch in an upper dielectric layer according to the tenth embodiment of the present invention and consumption power of the third PDP.

Figure 20A:
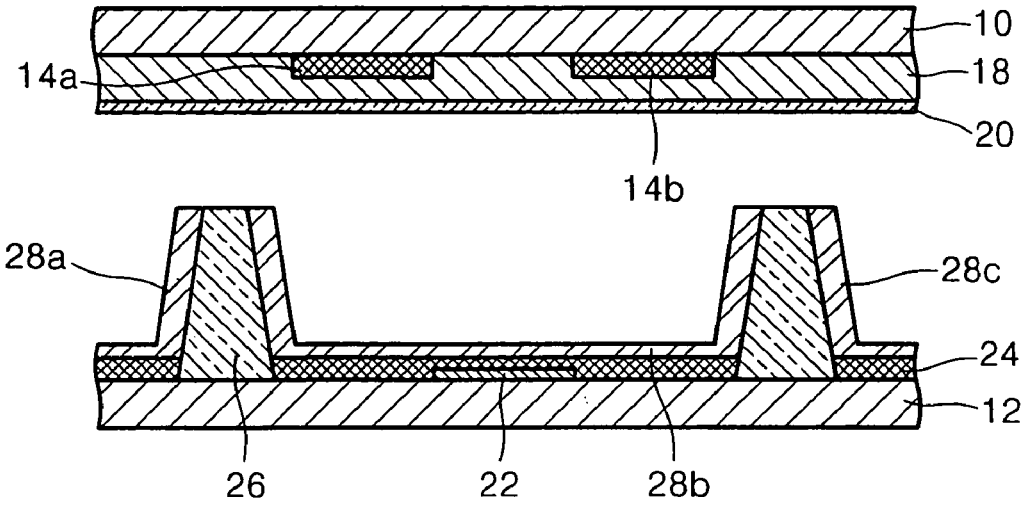
FIG. 20A (PRIOR ART)
FIG. 20A is a cross-section of the conventional PDP shown in FIG. 1.
Figure 21A:
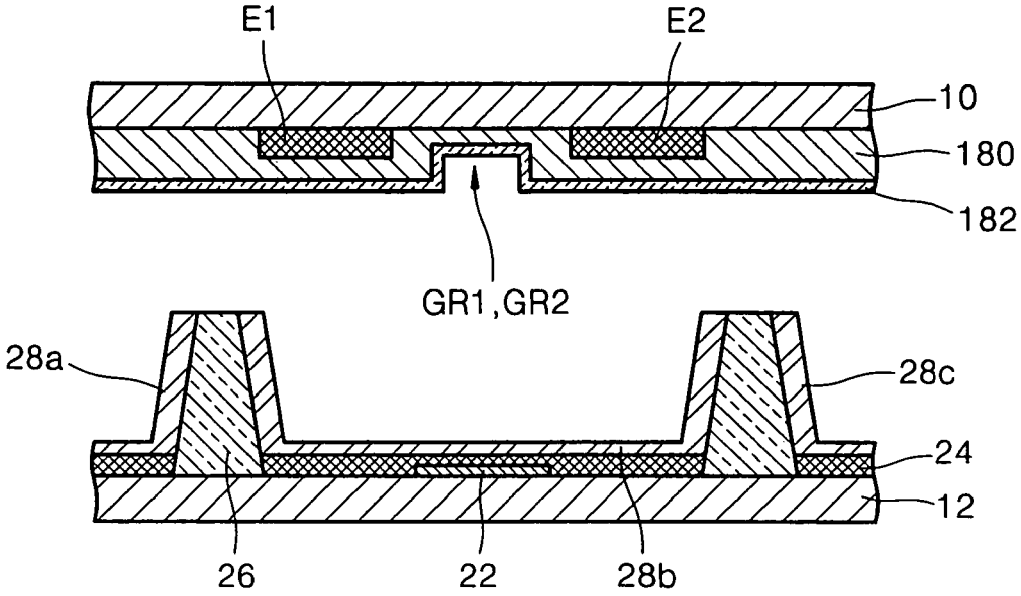
FIG. 21A is a cross-section of the PDP according to the tenth embodiment of the present invention.

FIG. 20A is a cross-section of the third PDP and FIG. 21A is a cross-section of a PDP (hereinafter, referred to as a fourth PDP) corresponding to the PDP according to the tenth embodiment of the present invention.

In FIG. 21A, reference characters E1 and E2 denote first and second electrodes, respectively, formed on a surface of the front glass substrate 10 facing the rear glass substrate 12. Each of the first and second electrodes E1 and E2 corresponds to an electrode including a main electrode and an auxiliary electrode in each of the above-described first through tenth embodiment of the present invention. Reference numeral 180 denotes a dielectric layer which covers the first and second electrodes E1 and E2 and has the first or second ditch GR1 or GR2 having a predetermined depth. Reference numeral 182 denotes a protective layer covers the entire surface of the dielectric layer 180.

Referring to FIGS. 20A and 21A, a dielectric layer exists between the first and second sustain electrodes 14*a* and 14*b* in the third PDP and between the first and second electrodes E1 and E2 in the fourth PDP. Accordingly, a parasitic capacitor can exist in an upper plate of each of the third and fourth PDPs. However, distribution of parasitic capacitors in the upper plate of the third PDP is different from that of in the upper plate of the fourth PDP because the structure of the upper plate of the third PDP is different from that of the third PDP. As a result, displacement current of the third PDP is different from that of the fourth PDP, and therefore, consumption power of the third PDP is different from that of the fourth PDP.

Figure 20B:
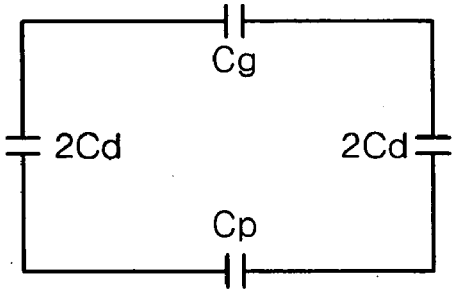
FIG. 20B (PRIOR ART)
FIG. 20B is an equivalent circuit diagram of the capacitance distribution before discharge of the PDP shown in FIG. 20A.
Figure 20C:
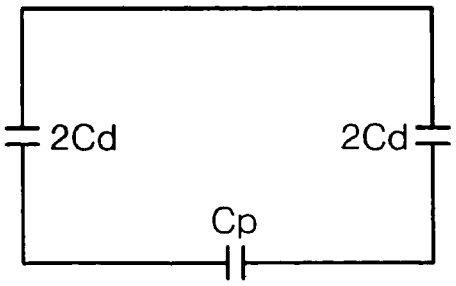
FIG. 20C (PRIOR ART)
FIG. 20C is an equivalent circuit diagram of the capacitance distribution after commencement of discharge of the PDP shown in FIG. 20A.

More specifically, FIGS. 20B and 20C are equivalent circuit diagrams showing parasitic capacitor distributions in the upper plate of the third PDP before and after the start of discharge. In FIGS. 20B and 20C, Cp denotes a capacitance (hereinafter, referred to as a first capacitance) of a capacitor including the first and second sustain electrodes 14*a* and 14*b* and the dielectric layer 18 existing between the first and second sustain electrodes 14*a* and 14*b*. Cd denotes a capacitance (hereinafter, referred to as a second capacitance) of a capacitor including the first and second sustain electrodes

14*a* and 14*b*, the protective layer 20, and the dielectric layer 18 existing among the first and second sustain electrodes 14*a* and 14*b* and the protective layer 20. Cg denotes a capacitance (hereinafter, referred to as a third capacitance) of a capacitor including the first and second sustain electrodes 14*a* and 14*b*, the dielectric layer 18 existing between the first and second sustain electrodes 14*a* and 14*b*, and gas in a discharge area.

Referring to FIG. 20B, the first through third capacitances Cp, Cd, and Cg exist before the start of discharge. However, when discharge starts, the gas in the discharge area has conductivity, and therefore, a gas dielectric layer disappears in the discharge area. As a result, the third capacitance Cg disappears when the discharge starts, as shown in FIG. 20C. The first and second capacitance do not change even after the discharge starts.

Figure 21B:
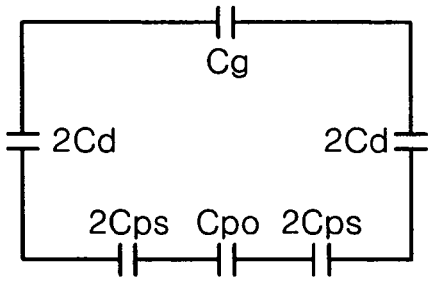
FIG. 21B is an equivalent circuit diagram of the capacitance distribution before discharge of the PDP shown in FIG. 21A.
Figure 21C:
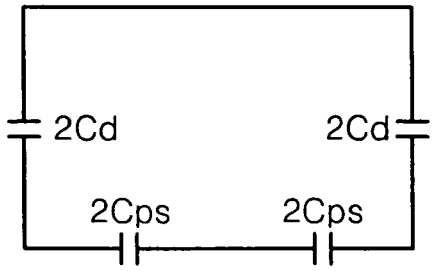
FIG. 21C is an equivalent circuit diagram of the capacitance distribution after commencement of discharge of the PDP shown in FIG. 21A.

FIGS. 21B and 21C show distributions of parasitic capacitors in the upper plate of the fourth PDP before and after the start of discharge. Cps denotes a capacitance (hereinafter, referred to as a fourth capacitance) of a capacitor including the first and second electrodes E1 and E2, the protective layer 182 formed on a side wall of the first or second ditch GR1 or GR2, and the dielectric layer 180 formed among the first and second electrodes E1 and E2 and the protective layer 182 formed on the side wall of the first or second ditch GR1 or GR2. Cpo denotes a capacitance (hereinafter, referred to as a fifth capacitance) of a capacitor including the protective layer 182 formed on the side wall of the first or second ditch GR1 or GR2 and a discharge gas existing in the ditch. The fourth capacitance Cps exists at both sides of the first or second ditch GR1 or GR2, and therefore, a total of two fourth capacitances Cps exist.

Before the start of discharge, the second through fifth capacitances exist in the upper plate of the fourth PDP, as shown in FIG. 21B. After the start of discharge, the discharge gas in the first or second ditch GR1 or GR2 has conductivity, and therefore, a gas dielectric layer in the first or second ditch GR1 or GR2 disappears. As a result, after the start of discharge, the fifth capacitance Cpo disappears from the upper plate of the fourth PDP.

Referring to FIGS. 20B and 21B, before the start of discharge, the first capacitance Cp in the third PDP corresponds to the fourth and fifth capacitances Cps and Cpo connected in serial in the fourth PDP. Accordingly, the sum of the fourth and fifth capacitances Cps and Cpo in the fourth PDP is less than the first capacitance Cp in the third PDP, as expressed in Formula (8).

$$Cp > \frac{Cpo + Cps}{Cpo \times Cps} \tag{8}$$

Since a displacement current is proportional to a capacitance, before the start of discharge, a displacement current induced between the first and second electrodes E1 and E2 in the fourth PDP is less than that induced between the first and second sustain electrodes 14*a* and 14*b* in the third PDP.

Consumption power W proportional to a displacement current fCV is expressed by Formula (9).

$$W = fCV^2 \tag{9}$$

Here, "f" denotes an alternating current (AC) voltage frequency, C denotes a capacitance, and V denotes an AC voltage.

As described above, a capacitance or displacement current fCV of a parasitic capacitor in the fourth PDP is less than that of a parasitic capacitor in the third PDP. Accordingly, it can be inferred from Formula (9) that the consumption power of the fourth PDP is less than that of third PDP.

A first simulation was performed to inspect changes in a discharge start voltage according to existence or non-existence of a resistance element as an auxiliary electrode in a sustain electrode. A second simulation was performed to inspect the relationship between a ditch formed in an upper dielectric layer and a discharge start voltage.

Figure 22:
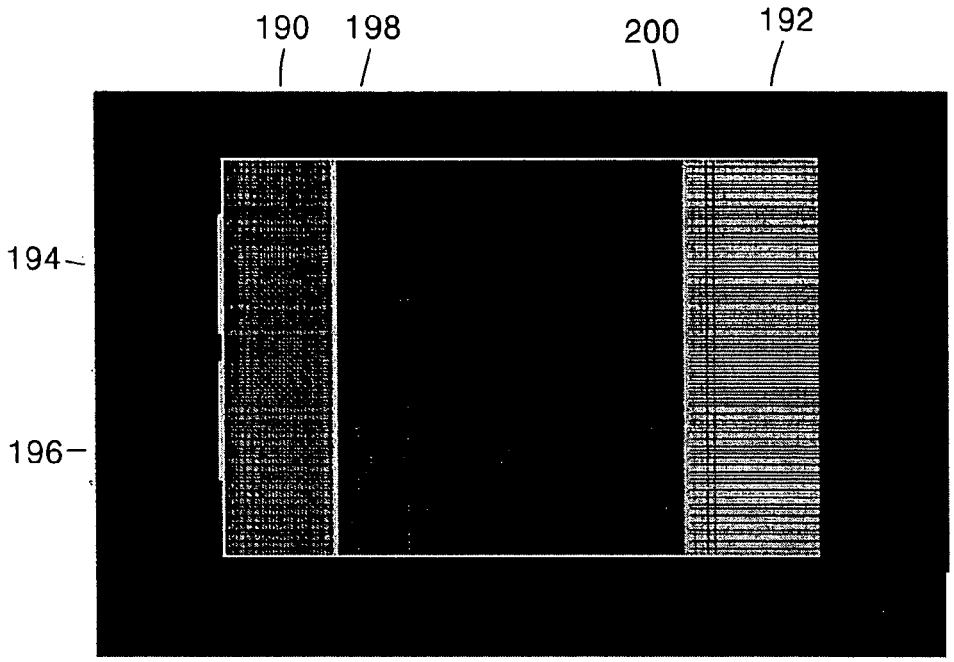
FIG. 22 (PRIOR ART)
FIGS. 22 and 23 are cross-sections of first and second simulated PDPs, respectively, used in a simulation performed to inspect influence of a gap between sustain electrodes upon a discharge voltage.
Figure 23:
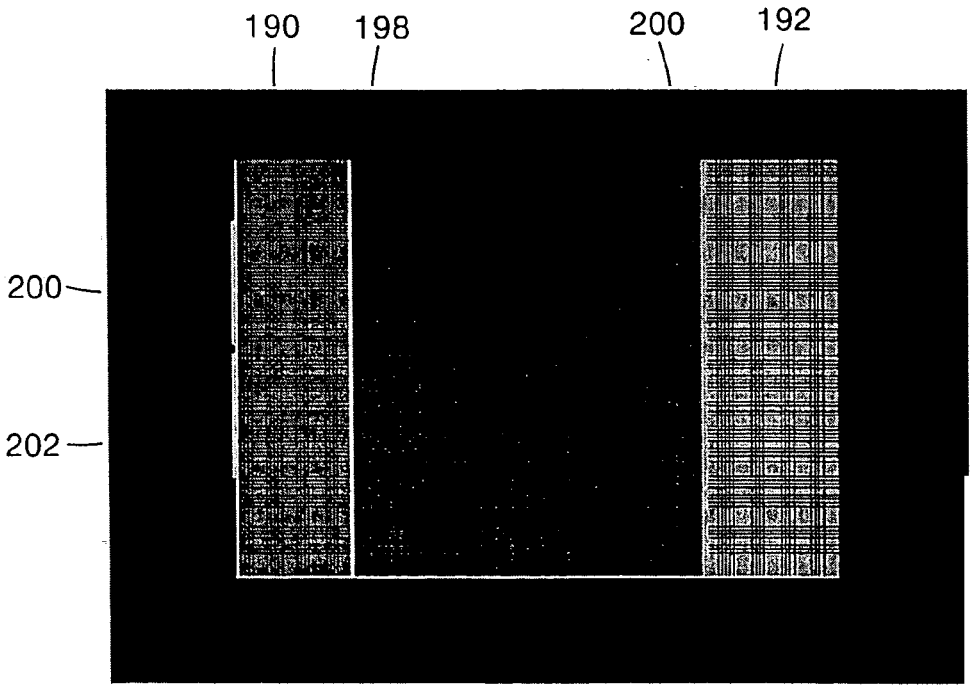

In the first simulation, a first simulated PDP shown in FIG. 22 was used as a conventional PDP, and a second simulated PDP shown in FIG. 23 was used as a PDP including a sustain electrode having a resistance element according to the present invention.

In FIG. 22, reference numerals 194 and 196 denote sustain electrodes, respectively, separated from each other by a first distance D1. Reference numeral 190 denotes an upper dielectric layer on one surface of which the sustain electrodes 194 and 196 are formed. A protective layer 198 is formed on an opposite surface of the upper dielectric layer 190. A lower dielectric layer 192 is formed to be separated from the protective layer 198 by a distance corresponding to a discharge space of the PDP. A fluorescent layer 200 is formed on a surface of the lower dielectric layer 192 facing the protective layer 198.

The second simulated PDP shown in FIG. 23 has the same structure as the first simulated PDP shown in FIG. 22, with the exception that sustain electrodes 200 and 202 in the second simulated PDP are separated from each other by a second distance D2 that is less than the first distance D1 by which the sustain electrodes 194 and 196 are separated from each other in the first simulated PDP. The second distance D2 corresponds to a gap between resistance elements included in different sustain electrodes, respectively, in each of the PDPs according to the first through tenth embodiments of the present invention.

In the first simulation, the thickness of the upper and lower dielectric layers 190 and 192 was 30 μm, and a dielectric material having a dielectric constant of 12 was used in the first and second simulated PDPs shown in FIGS. 22 and 23. The width of the sustain electrodes 194, 196, 200 and 202 was 320 μm. The first distance D1 was 80 μm, and the second distance D2 was 20 μm. Pulses of a voltage applied to each of the sustain electrodes 194, 196, 200 and 202 had a width of 5 μs. In addition, a mixture gas of Ne and Xe was used as a discharge gas in the first and second simulated PDPs, and a Xe ratio was changed from 5% to 10% and 30%. A pressure was maintained at 505 torr.

Table 1 shows the results of measuring a discharge start voltage in the first and second simulated PDPs.

TABLE 1

| Xe ratioPDP type | 5% | 10% | 30% |
|---|---|---|---|
| First simulated PDP | 216 V | 237 V | 326 V |
| Second simulated PDP | 198 V | 216 V | 284 V |

Referring to Table 1, the discharge start voltage is lower in the second simulated PD than in the first simulated PDP regardless of the Xe ratio. This result means that when a sustain electrode includes a resistance element according to the present invention, discharge can be started at a lower voltage than in the conventional PDP. It also means that when the discharge start voltage of the second simulated PDP is the same as that of the first simulated PDP, the Xe ratio in the second simulated PDP can be increased to be higher than that in the first simulated PDP.

When the Xe ratio is increased, light emission efficiency is also increased. Accordingly, when the same discharge start voltage is used, the light emission efficiency of the second simulated PDP is higher than that of the first simulated PDP.

Figure 24:
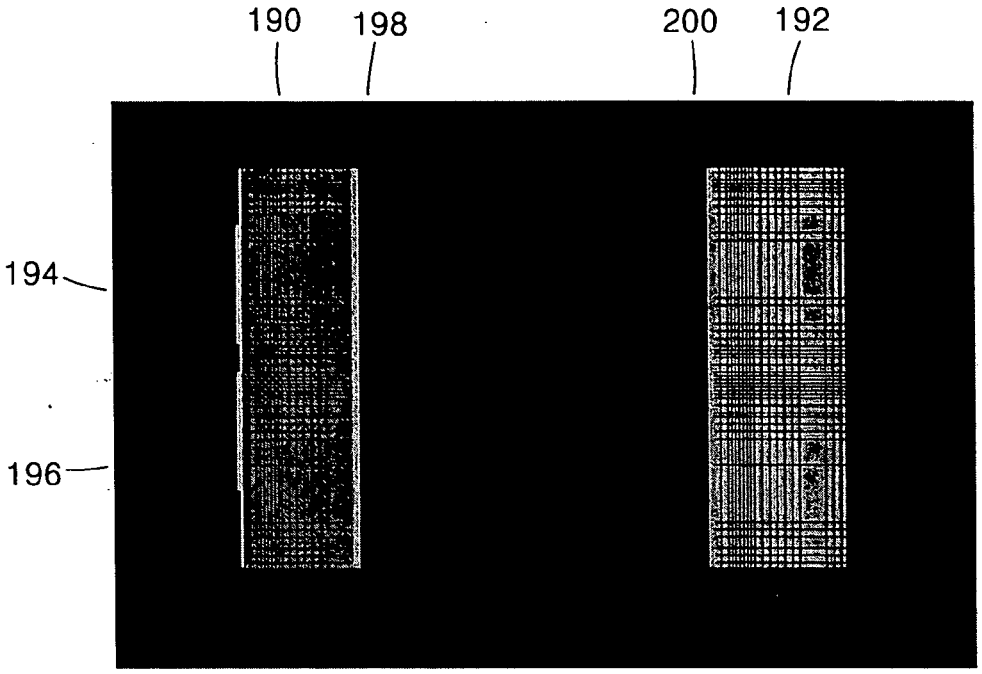
FIG. 24 (PRIOR ART)
FIGS. 24 and 25 are cross-sections of third and fourth simulated PDPs of conventional technology and the tenth embodiment of the present invention, respectively.
Figure 25:
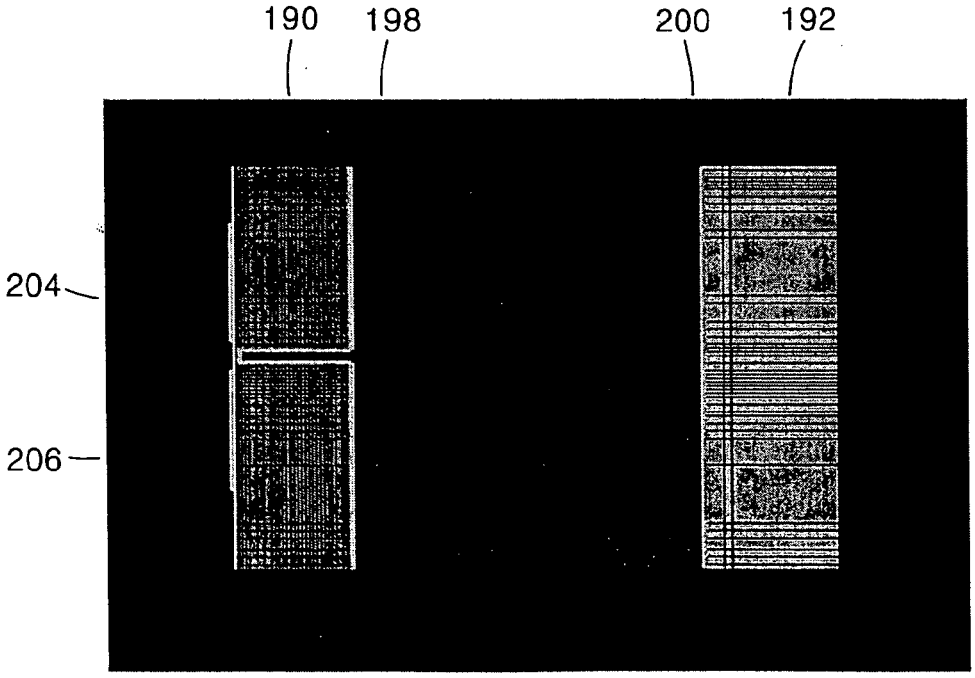

In the second simulation, a third simulated PDP shown in FIG. 24 was used as a conventional PDP, and a fourth simulated PDP shown in FIG. 25 was used as a PDP in which a sustain electrode includes a resistance element and a ditch is formed in a dielectric layer covering the sustain electrode according to the present invention. In FIGS. 22 through 25, the same reference numerals denote the same members.

As shown in FIG. 24, the third simulated PDP is the same as the first simulated PDP, and thus a description thereof will be omitted.

The fourth simulated PDP shown in FIG. 25 includes two sustain electrodes 204 and 206 on one surface of the upper dielectric layer. The two sustain electrodes 204 and 206 are separated from each other by the second distance D2 (FIG. 23). A ditch 208 is formed in the upper dielectric layer 190 between the two sustain electrodes 204 and 206. The protective layer 198 is formed on an opposite surface of the upper dielectric layer 190 to cover the entire surface of the ditch 208. The other parts of the fourth simulated PDP are the same as those of the second simulated PDP.

In the second simulation, the thickness of the upper and lower dielectric layers 190 and 912, a dielectric material, the width of the sustain electrodes 194, 196, 204, and 206, the width of pulses of a voltage applied to the sustain electrodes 194, 196, 204, and 206, a discharge gas, and a Xe ratio in the discharge gas were the same in the third and fourth simulated PDPs. The Xe ratio was increased from 5% to 10% and 30%, and a pressure was maintained at 505 torr.

Table 2 shows the results of measuring a discharge start voltage in the third and fourth simulated PDPs.

TABLE 2

| Xe ratioPDP type | 5% | 10% | 30% |
|---|---|---|---|
| Third simulated PDP | 216 V | 237 V | 326 V |
| Fourth simulated PDP | 162 V | 170 V | 198 V |

Referring to Table 2, the discharge start voltage is much lower in the fourth simulated PD than in the third simulated PDP. In particular, when Table 1 is compared Table 2, the discharge start voltage of the fourth simulated PDP is much lower than that of the second simulated PDP.

According to the results of the first and second simulations, it can be inferred that when two sustain electrodes include resistance elements, respectively, separated by a less distance than a distance between the two sustain electrodes, and a ditch is formed in a dielectric layer covering the sustain electrodes and the resistance elements in a PDP, a discharge start voltage is decreased compared to a PDP including a resistance element without a ditch according to the present invention as well as the conventional PDP.

Consequently, in the fourth simulated PDP, discharge can be started at a lower voltage than used in the third simulated PDP, and a Xe ratio in a discharge gas can be increased, thereby providing high light emission efficiency at a lower discharge start voltage.

The following description concerns a method of manufacturing a PDP according to an embodiment of the present invention, and more particularly, a method of manufacturing a sustain electrode used in a PDP. Here, the first through eighth sustain electrodes are referred to as main electrodes, and the resistance elements are referred to as auxiliary electrodes. In addition, the assumption is made that a sustain electrode includes a main electrode and an auxiliary electrode.

Figure 26:
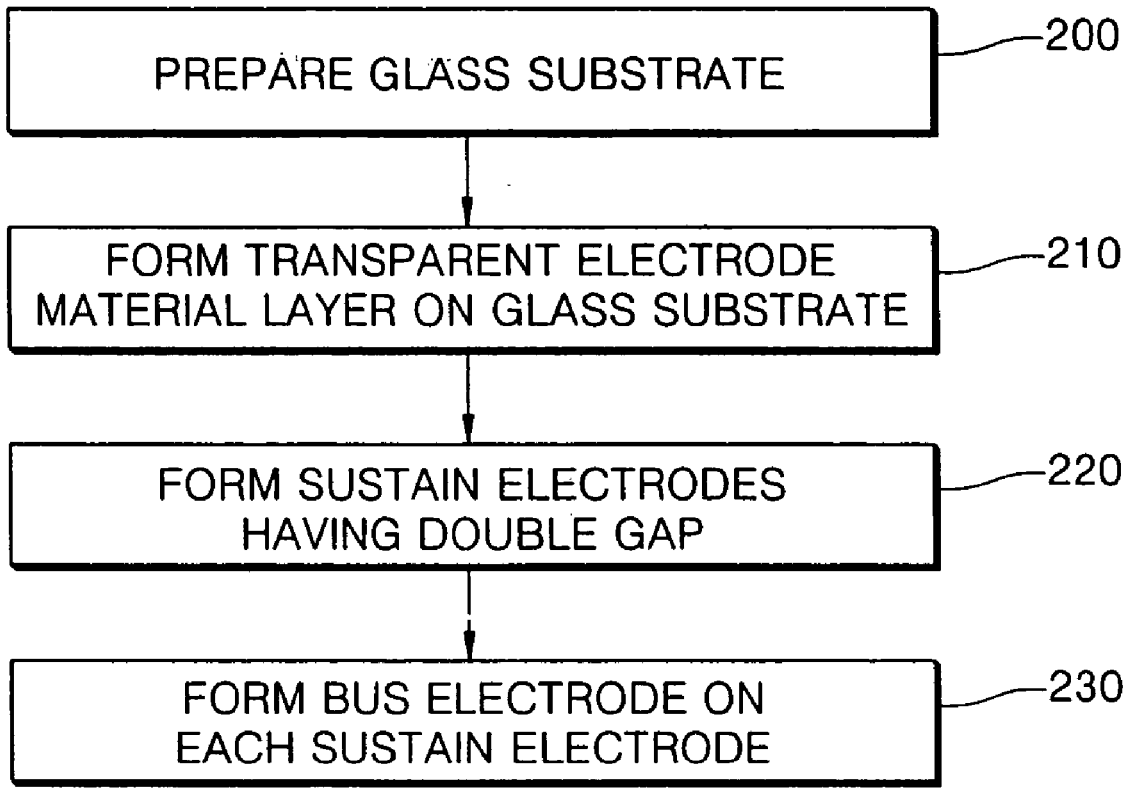
FIG. 26 is a flowchart of a method of manufacturing sustain electrodes in the PDP shown in FIG. 4.

Referring to FIG. 26, a clean glass substrate is prepared in step 200. This glass substrate is used as a front glass substrate. Next, a transparent electrode material layer, for example, an indium tin oxide (ITO) layer, which has a high light transmittance and suitable for forming a sustain electrode, is formed on the glass substrate in step 210. The transparent electrode material layer is patterned, thereby forming sustain electrodes having a double gap in step 220.

More specifically, each sustain electrode includes a space, and one of the resistance elements shown in FIGS. 4 through 12 is formed in the space. In other words, each sustain electrode includes a main electrode (one of the first through eighth sustain electrodes), which includes the space and through which most current flows, and an auxiliary electrode (one of the first through twentieth resistance elements), which is formed in the space and connected to the main electrode. It is preferable that the main and auxiliary electrodes are simultaneously and integrally formed. In addition, it is preferable that a gap between two adjacent main electrodes is greater than a gap between auxiliary electrodes formed on the respective main electrodes so that the two adjacent sustain electrodes have a double gap.

The sustain electrodes having the above-described features can be acquired by reflecting these features on a process of patterning a photoresist layer deposited on the transparent electrode material layer. In other words, by reflecting these features of the sustain electrodes on a process of patterning the photoresist layer, a photoresist layer pattern having these features, i.e., the same shape of the sustain electrodes, is formed. Then, by etching the transparent electrode material layer using the photoresist layer pattern as an etch mask, the sustain electrodes having these features are formed on the glass substrate.

The sustain electrodes shown in one of FIGS. 4 through 12 or one of combinations of the sustain electrodes shown in FIGS. 4 through 12 can be formed in step 220. For example, one of two adjacent sustain electrode is formed to include the first sustain electrode 40 and the first resistance element composed of the body 52*a* and the end portion 52*b*, shown in FIG. 4, and the other one is formed to include one of the sustain electrodes shown in FIGS. 5 through 12 and one of the second through eighteenth resistance elements.

After forming the sustain electrodes on the glass substrate, bus electrodes are formed on the respective sustain electrodes to be parallel with the respective sustain electrodes in step 230. Black stripes (not shown) are formed between the sustain electrodes, and a dielectric layer (168 shown in FIG. 14) is formed to cover the sustain electrodes, the sub electrodes, and the black stripes. The dielectric layer 168 can include a single layer, as shown in FIG. 14, or multi layers by sequentially forming the first and second dielectric layers 172 and 174, as shown in FIG. 15. Thereafter, as shown in FIG. 14, the first ditch GR1 is formed in the dielectric layer 168. Alternatively, as shown in FIG. 15, the second ditch GR2 can be formed in the dielectric layer 168. Preferably, the first and second ditches GR1 and GR2 are formed possibly deep but do not expose the resistance elements 160*a* and 162*a*. Accordingly, it is preferable that the second ditch GR2 is formed to expose the first dielectric layer 172. However, the second ditch GR2 can be formed deeper toward the first dielectric layer 172. The first or second ditch GR1 or GR2 can be easily formed using a typical photo etching process.

Succeeding processes such as a process of forming a protective layer on the dielectric layer 168 having the first or second ditch GR1 or GR2, a seal line printing process, and a process of forming a protective layer, processes for forming a rear glass substrate panel, a process of sealing the front glass substrate panel to the rear glass substrate panel, a process of injecting a plasma forming gas, and a packaging process are performed according to a typical procedure. However, it is preferable that the plasma forming gas is a mixed gas of Ne and Xe, which contains 4–20% Xe.

As described above, a sustain electrode used in a PDP according to the present invention includes a main electrode, through which most current flows after the start of a discharge, and an auxiliary electrode (i.e., a resistance element), which has a high resistance for a low voltage discharge. In addition, a ditch is formed immediately above the auxiliary electrode in a dielectric layer covering the main and auxiliary electrodes. A gap between auxiliary electrodes included in different sustain electrodes, respectively, is narrower than a gap between the main electrodes. Accordingly, a discharge start voltage can be decreased compared to conventional PDPs. In particular, application of a discharge voltage induces an intensive electric field in the ditch, which facilitates discharge of the discharge gas in the ditch. Accordingly, the discharge start voltage can be further lowered in a PDP including the ditch as well as the auxiliary electrode according to the present invention. Moreover, the gap between the main electrodes in a PDP according to the present invention is as wide as a gap between sustain electrodes in the conventional PDPs. Accordingly, degradation of brightness and efficiency can be prevented in a PDP according to the present invention while the discharge start voltage can be lowered by more than 20 V compare to the conventional PDPs.

Figure 2:
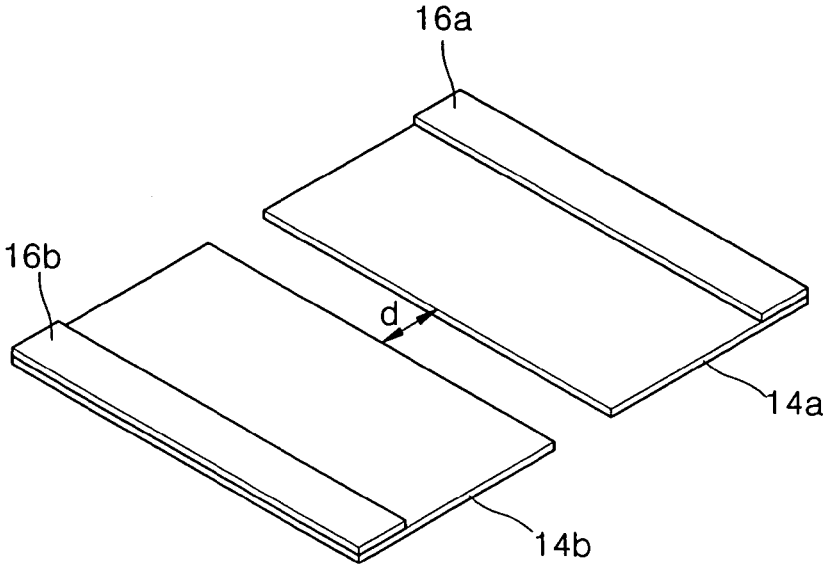
FIG. 2 (PRIOR ART)
FIG. 2 is a perspective view of sustain electrodes and bus electrodes, which are elements of the conventional PDP shown in FIG. 1.

While this invention has been particularly shown and described with reference to exemplary embodiments thereof, these embodiments should be considered in descriptive senses only and not for purposes of limitation. For example, those skilled in the art of the present invention can use auxiliary electrodes (i.e., resistance elements) having different shapes from those described in the above embodiments without departing from the spirit of the invention. For example, instead of providing an auxiliary electrode in a groove formed in a sustain electrode, resistance elements according to the present invention can be provided in the conventional sustain electrodes 14*a* and 14*b*, respectively, which do not have a groove, as shown in FIG. 2. In other words, a resistance element can be provided at an end of the sustain electrode 14*a* to face the sustain electrode 14*b*, and a resistance element can be provided at an end of the sustain electrode 14*b* to face the sustain electrode 14*a*. Here, the two resistance elements can be positioned to face each other or alternate with each other. Alternatively, only one of two facing sustain electrodes can have a groove, so a resistance element can be provided at an end of one sustain electrode not having a groove, and a resistance element can be provided in the groove formed in the other sustain electrode. In addition, a ditch can be formed immediately above only a single resistance element. As described above, since various modifications can be made to the above-described embodiments, the scope of the invention is defined not by the detailed description of the invention but by the appended claims.

What is claimed is:

1. A plasma display panel comprising:

a front panel adapted to display an image, the front panel comprising a plurality of sustain electrodes, a plurality of bus electrodes, a first dielectric layer covering both the plurality of sustain electrodes and the bus electrodes, and a protective layer;

a rear panel separated from the front panel and hermetically sealed to the front panel, the rear panel comprising a plurality of data lines, a second dielectric layer covering the plurality of data lines, a plurality of barrier ribs, and a fluorescent layer; and a plasma forming gas arranged between the front and rear panels, wherein a first sustain electrode selected from the plurality of sustain electrodes and a second sustain electrode facing the first sustain electrode have a double gap to allow a discharge voltage to be decreased without reducing a discharge efficiency, to allow a discharge to be started at a low voltage, and to allow the low voltage discharge to stop after the start of a sustaining discharge;

wherein the first sustain electrode comprises:

a first main electrode adapted to sustain the discharge after the discharge is started at the low voltage; and a first auxiliary electrode connected to the first main electrode and adapted to start the low voltage discharge, the first auxiliary electrode being a resistance element.

2. The plasma display panel of claim 1, wherein the first auxiliary electrode comprises a first resistance element provided at an end of the first main electrode to face the second sustain electrode.

3. The plasma display panel of claim 1, wherein the plasma forming gas comprises a mixed gas of neon (Ne) and xenon (Xe) and contains 4–20 mole % Xe.

4. The plasma display panel of claim 1, wherein the front panel further comprises a ditch arranged above the first auxiliary electrode in the first dielectric layer.

5. The plasma display panel of claim 4, wherein the first dielectric layer comprises upper and lower dielectric layers having different dielectric constants, the ditch being arranged to expose the lower dielectric layer lying below the upper dielectric layer.

6. The plasma display panel of claim 1, further comprising a first groove arranged in the first main electrode, the first auxiliary electrode being disposed within the first groove.

7. The plasma display panel of claim 6, wherein the first groove is arranged near one of the plurality of barrier ribs.

8. The plasma display panel of claim 6, wherein an entrance of the first groove is narrower than the inside of the first groove.

9. The plasma display panel of claim 8, wherein the first auxiliary electrode comprises a body disposed within the first groove and an end portion extending from the body and disposed between the first and second sustain electrodes.

10. The plasma display panel of claim 9, wherein the body of the first auxiliary electrode has a serpentine shape in a horizontal plane or a vertical plane.

11. The plasma display panel of claim 9, wherein the end portion of the first auxiliary electrode is parallel with or perpendicular to a bus electrode arranged on the first sustain electrode or has a pointed shape.

12. The plasma display panel of claim 6, wherein the first auxiliary electrode comprises a body disposed within the first groove and an end portion extending from the body and disposed between the first and second sustain electrodes.

13. The plasma display panel of claim 12, wherein the body of the first auxiliary electrode has a serpentine shape in a horizontal plane or a vertical plane.

14. The plasma display panel of claim 12, wherein the end portion of the first auxiliary electrode is parallel with or perpendicular to a bus electrode arranged on the first sustain electrode.

15. The plasma display panel of claim 4, wherein the first groove is arranged immediately above one of the plurality of barrier ribs.

16. A plasma display panel comprising:

a front panel adapted to display an image, the front panel comprising a plurality of sustain electrodes, a plurality of bus electrodes, a first dielectric layer covering both the plurality of sustain electrodes and the bus electrodes, and a protective layer;

a rear panel separated from the front panel and hermetically sealed to the front panel, the rear panel comprising a plurality of data lines, a second dielectric layer covering the plurality of data lines, a plurality of barrier ribs, and a fluorescent layer; and a plasma forming gas arranged between the front and rear panels, wherein a first sustain electrode selected from the plurality of sustain electrodes and a second sustain electrode facing the first sustain electrode have a double gap to allow a discharge voltage to be decreased without reducing a discharge efficiency, to allow a discharge to be started at a low voltage, and to allow the low voltage discharge to stop after the start of a sustaining discharge;

wherein the second sustain electrode comprises:

a second main electrode adapted to sustain the sustaining discharge after the discharge is started at the low voltage; and a second auxiliary electrode connected to the second main electrode and adapted to start the low voltage discharge, the second auxiliary electrode being a resistance element.

17. The plasma display panel of claim 16, wherein the second auxiliary electrode comprises a second resistance element provided at an end of the second main electrode to face the first sustain electrode.

18. The plasma display panel of claim 17, wherein the first auxiliary electrode comprises a first resistance element provided at an end of the first main electrode to face the second sustain electrode or the second resistance element.

19. The plasma display panel of claim 16, wherein the front panel further comprises a ditch arranged above the first and second auxiliary electrodes in the first dielectric layer.

20. The plasma display panel of claim 19, wherein the first dielectric layer comprises upper and lower dielectric layers having different dielectric constants, the ditch being arranged to expose the lower dielectric layer lying below the upper dielectric layer.

21. The plasma display panel of claim 16, further comprising a second groove arranged in the second main electrode, the second auxiliary electrode being disposed within the second groove.

22. The plasma display panel of claim 21, wherein the second groove is arranged near one of the plurality of barrier ribs.

23. The plasma display panel of claim 21, wherein an entrance of the second groove is narrower than the inside of the second groove.

24. The plasma display panel of claim 23, wherein the second auxiliary electrode comprises a body disposed within the second groove and an end portion extending from the body and disposed between the first and second sustain electrodes.

25. The plasma display panel of claim 24, wherein the body of the second auxiliary electrode has a serpentine shape in a horizontal plane or a vertical plane.

26. The plasma display panel of claim 24, wherein the end portion of the second auxiliary electrode is parallel with or perpendicular to a bus electrode formed on the second sustain electrode.

27. The plasma display panel of claim 21, wherein the second auxiliary electrode comprises a body disposed within the second groove and an end portion extending from the body and disposed between the first and second sustain electrodes.

28. The plasma display panel of claim 27, wherein the body of the second auxiliary electrode has a serpentine shape in a horizontal plane or a vertical plane.

29. The plasma display panel of claim 27, wherein the end portion of the second auxiliary electrode is parallel with or perpendicular to a bus electrode formed on the second sustain electrode or has a pointed shape.

30. The plasma display panel of claim 21, further comprising a first groove arranged in the first main electrode, the first auxiliary electrode being disposed within the first groove.

31. The plasma display panel of claim 30, wherein the first and second groove are vertically symmetrical.

32. The plasma display panel of claim 30, wherein the first and second groove are diagonally symmetrical.

33. The plasma display panel of claim 13, wherein the second groove is arranged immediately above one of the plurality of barrier ribs.

34. A plasma display panel comprising:

a front panel adapted to display an image, the front panel comprising a plurality of sustain electrodes, a plurality of bus electrodes, a first dielectric layer covering both the plurality of sustain electrodes and the bus electrodes, and a protective layer;

a rear panel separated from the front panel and hermetically sealed to the front panel, the rear panel comprising a plurality of data lines, a second dielectric layer covering the plurality of data lines, a plurality of barrier ribs, and a fluorescent layer; and a plasma forming gas arranged between the front and rear panels, wherein at least one of the plurality of sustain electrodes comprises a main electrode adapted to sustain a discharge and an auxiliary electrode having a high resistance and adapted to start the discharge, and the auxiliary electrode being connected to the main electrode such that at least part of the auxiliary electrode is arranged between two facing sustain electrodes.

35. The plasma display panel of claim 34, wherein the auxiliary electrode comprises a body having a serpentine shape in a horizontal plane or a vertical plane and an end portion extending from the body to be disposed between the two facing sustain electrodes.

36. The plasma display panel of claim 35, further comprising a groove arranged in the main electrode, the body of the auxiliary electrode being disposed within the groove.

37. The plasma display panel of claim 36, wherein the groove is arranged immediately above one of the plurality of barrier ribs.

38. The plasma display panel of claim 35, wherein the end portion is parallel with or perpendicular to a sustain electrode that the end portion faces.

39. The plasma display panel of claim 36, wherein an entrance of the groove is narrower than the inside of the groove.

40. The plasma display panel of claim 34, wherein the auxiliary electrode is connected to an end of the main electrode, the entire auxiliary electrode being disposed between the two facing sustain electrodes.

41. The plasma display panel of claim 34, wherein a ditch of a predetermined depth is arranged within the first dielectric layer immediately above the auxiliary electrode.

42. The plasma display panel of claim 41, wherein the first dielectric layer comprises lower and upper dielectric layers having different dielectric constants, and the ditch is arranged to expose the lower dielectric layer lying below the upper dielectric layer.

43. A method of manufacturing a plasma display panel including a front panel having a front glass substrate, a plurality of sustain electrodes, a plurality of bus electrodes, and a first dielectric layer covering both the plurality of sustain electrodes and the bus electrodes, and a protective layer; a rear panel separated from the front panel and hermetically sealed to the front panel, the rear panel having a rear glass substrate, a plurality of data lines, a second dielectric layer covering the plurality of data lines, a plurality of barrier ribs, and a fluorescent layer; and a plasma forming gas arranged between the front and rear panels, the method comprising:

forming the sustain electrodes such that each sustain electrode faces another sustain electrode with a double gap allowing a discharge to be started at a low voltage without decreasing discharge efficiency between the two facing sustain electrodes and allowing a low-voltage discharge to stop after the start of a sustaining discharge; and wherein at least one of the two facing sustain electrodes is formed to comprise:

a main electrode adapted to sustain a discharge after the low voltage discharge is started; and an auxiliary electrode having a high resistance and adapted to start the low voltage discharge.

44. The method of claim 43, wherein forming the sustain electrodes having the double gap therebetween comprises:

forming a transparent electrode material layer for forming the sustain electrodes on a surface of the front glass substrate, which faces the rear glass substrate panel;

depositing a photoresist layer on the transparent electrode material layer;

patterning the photoresist layer to have the same pattern as the sustain electrodes, thereby forming a photoresist layer pattern having a double gap;

etching the transparent electrode material layer using the photoresist layer pattern as an etch mask; and removing the photoresist layer pattern.

45. The method of claim 43, further comprising forming a ditch in the first dielectric layer immediately above the double gap.

46. The method of claim 45, wherein the first dielectric layer is formed by sequentially stacking a lower dielectric layer and an upper dielectric layer having different dielectric constants, and the ditch is formed to expose the lower dielectric layer lying below the upper dielectric layer.

47. The method of claim 43, wherein the main and auxiliary electrodes are integrally and simultaneously formed.

48. The method of claim 47, further comprising forming a groove in the main electrode, and forming the auxiliary electrode in the groove.

49. The method of claim 48, wherein the auxiliary electrode comprises a body formed within the groove and an end portion extending from the body out of the groove to be disposed between the two facing sustain electrodes, and wherein the body has a serpentine shape in a horizontal plane or a vertical plane.

50. The method of claim 49, wherein the end portion is parallel with or perpendicular to bus electrodes formed on the two facing sustain electrodes, respectively, or has a pointed shape.

51. The method of claim 48, wherein an entrance of the groove is narrower than the inside of the groove.

52. The method of claim 48, the groove is formed immediately above one of the plurality of barrier ribs.

53. The method of claim 47, further comprising forming the auxiliary electrode at an end of the main electrode such that the auxiliary electrode is disposed between the two facing sustain electrodes.

54. The method of claim 47, wherein the auxiliary electrode is formed in each of the two facing sustain electrodes such that the auxiliary electrodes in the respective two facing sustain electrodes are vertically or diagonally symmetrical.

* * * * *